US006645714B2

(12) United States Patent
Oya et al.

(10) Patent No.: US 6,645,714 B2
(45) **Date of Patent: *Nov. 11, 2003**

(54) PHOTOTHERMOGRAPHIC MATERIAL

(75) Inventors: Toyohisa Oya, Minami-Ashigara (JP); Kazunobu Katoh, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/809,318

(22) Filed: Mar. 16, 2001

(65) Prior Publication Data

US 2001/0051319 A1 Dec. 13, 2001

(30) Foreign Application Priority Data

Mar. 17, 2000 (JP) ..... 2000-076240

(51) Int. Cl.[7] ..... G03C 1/498; G03C 1/35

(52) U.S. Cl. ..... 430/619; 430/600; 430/613; 430/620; 430/965

(58) Field of Search ..... 430/619, 965, 430/600, 613, 620

(56) References Cited

U.S. PATENT DOCUMENTS

| | | | | |
|---|---|---|---|---|
| 5,698,365 | A | | 12/1997 | Taguchi et al. |
| 6,090,538 | A | | 7/2000 | Arai et al. |
| 6,146,813 | A | | 11/2000 | Girard et al. |
| 6,146,822 | A | * | 11/2000 | Asanuma et al. ..... 430/619 |

FOREIGN PATENT DOCUMENTS

| | | |
|---|---|---|
| EP | 0803764 | * 10/1997 |
| JP | 10221806 | 8/1998 |

* cited by examiner

*Primary Examiner*—Thorl Chea
(74) *Attorney, Agent, or Firm*—Birch, Stewart, Kolasch & Birch, LLP

(57) ABSTRACT

A photothermographic material comprising at least (a) a photosensitive silver halide, (b) a reducible silver salt, (c) a reducing agent represented by the following formula (1), (d) a binder, and (e) a phenol compound represented by the following formula (2) on the same side of a support:

(1)

(1)

wherein, in the formula (1), $V^1$ to $V^8$ each independently represent hydrogen atom or a substituent, L represents a bridging group consisting of —CH($V^9$)— or —S—, and $V^9$ represents hydrogen atom or a substituent;

(2)

wherein, in the formula (2), $R^1$ and $R^2$ each independently represent hydrogen atom or a substituent, $X^1$ to $X^3$ each independently represent hydrogen atom or a substituent, provided that the substituents represented by $X^1$ to $X^3$ do not represent hydroxy group, and when the substituents represented by $X^1$ to $X^3$ are bonded to the phenol ring via nitrogen atoms, $X^1$ to $X^3$ represent a nitrogen-containing heterocyclic group or a group represented as —NH—C(=O)—$R^4$ where $R^4$ represents a substituent having 8–40 carbon atoms, or the substituents represented by $R^1$, $R^2$ and $X^1$ to $X^3$ may be bound to each other to form a ring. There is provided a photothermographic material, in particular, for photographic art, more specifically, for scanners, image setters and so forth, that shows high sensitivity, high Dmax (maximum density) and low fog and can provide images suitable for photographic art.

17 Claims, 1 Drawing Sheet

PHOTOTHERMOGRAPHIC MATERIAL

FIELD OF THE INVENTION

The present invention relates to a photothermographic material. In particular, the present invention relates to a photothermographic material for scanners, image setters and so forth, which is especially suitable for photographic art. More precisely, the present invention relates to a photothermographic material for photographic art, which shows high sensitivity, high image density (Dmax) and low fog and can provide images suitable for photographic art.

BACKGROUND OF THE INVENTION

There are known many photosensitive materials having a photosensitive layer on a support, with which image formation is attained by light-exposing imagewise. Those materials include those utilizing a technique of forming images by heat development as systems that can contribute to the environmental protection and simplify image-forming means.

In recent years, reduction of amount of waste processing solutions is strongly desired in the field of photographic art from the standpoints of environmental protection and space saving. Therefore, development of techniques relating to photothermographic materials for photographic art is required, which materials enable efficient exposure by a laser scanner or laser image setter and formation of clear black images having high resolution and sharpness. Such photothermographic materials can provide users with simpler and non-polluting heat development processing systems which eliminate the use of solution-type processing chemicals.

Methods for forming images by heat development are described in, for example, U.S. Pat. Nos. 3,152,904 and 3,457,075 and D. Klosterboer, "Thermally Processed Silver Systems A", Imaging Processes and Materials, Neblette, 8th ed., compiled by J. Sturge, V. Walworth and A. Shepp, Chapter 9, p.279, (1989). Such photothermographic materials comprise a reducible non-photosensitive silver salt (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced from the reaction of the reducible silver salt in the exposed areas shows black color and provides contrast with respect to the non-exposed areas, and thus images are formed.

European Patent Publication (hereinafter referred to as EP-A) 762,196, Japanese Patent Laid-open Publication (Kokai, hereinafter referred to as JP-A) 9-90550 and so forth disclose that high-contrast photographic property can be obtained by incorporating Group VII or VIII metal ions or metal complex ions of such a metal into photosensitive silver halide grains for use in photothermographic materials, or incorporating a hydrazine derivative into the photosensitive materials. Further, U.S. Pat. No. 5,545,515 discloses use of hindered phenols as a reducing agent and use of acrylonitrile compounds as an ultrahigh contrast agent.

Furthermore, there are also reported examples of use of phenol compounds as a reducing agent, which compounds have an amino group substituted with an electron withdrawing group as a substituent (e.g., sulfonamidophenol compounds). For example, as described in JP-A-49-80386, JP-A-5-257227 and JP-A-10-221806, there are known methods of individually utilizing 2,6-dichloro-4-benzenesulfonamidophenol, p-benzenesulfonamidophenol and so forth as a reducing agent. However, even use of these compounds cannot improve sensitivity and cannot solve the problems concerning change of photographic performance during storage of photosensitive materials (in particular, fog).

Accordingly, it has been desired to provide a photothermographic material for photographic art, which shows high sensitivity, high Dmax (maximum density) and low fog and can provide images suitable for photographic art.

SUMMARY OF THE INVENTION

The objects of the present invention are to solve the aforementioned problems of the prior art. That is, a first object to be achieved by the present invention is to provide a photothermographic material which shows high sensitivity, high Dmax (maximum density) and low fog, and can provide images suitable for photographic art, in particular, as a photothermographic material for photographic art, more specifically, a photothermographic material for scanners, image setters and so forth.

A second object to be achieved by the present invention is to provide a photothermographic material which can be prepared by coating of an aqueous system, which is advantageous in view of environment and cost.

The inventors of the present invention assiduously studied in order to achieve the aforementioned objects. As a result, they found that an excellent photothermographic material which provides the desired effects could be obtained by containing a particular bisphenol compound and a particular phenol compound on the image-forming layer side, and thus accomplished the present invention.

That is, the present invention provides a photothermographic material comprising at least (a) a photosensitive silver halide, (b) a reducible silver salt, (c) a reducing agent represented by the following formula (1), (d) a binder, and (e) a phenol compound represented by the following formula (2) on the same side of a support.

(1)

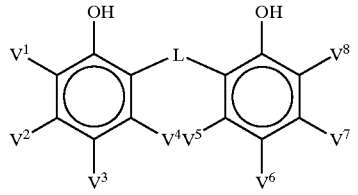

(1)

In the formula (1), $V^1$ to $V^8$ each independently represent hydrogen atom or a substituent. L represents a bridging group consisting of —CH($V^9$)— or —S—. $V^9$ represents hydrogen atom or a substituent.

(2)

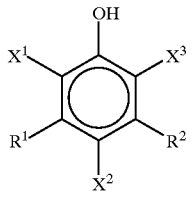

In the formula (2), $R^1$ and $R^2$ each independently represent hydrogen atom or a substituent. $X^1$ to $X^3$ each independently represent hydrogen atom or a substituent, provided that the substituents represented by $X^1$ to $X^3$ do not represent hydroxy group, and when the substituents represented by $X^1$ to $X^3$ are bonded to the phenol ring via nitrogen atoms, $X^1$ to $X^3$ represent a nitrogen-containing heterocyclic group or a group represented as —NH—C(=O)—$R^4$ where $R^4$ represents a substituent having 8–40 carbon atoms. The substituents represented by $R^1$, $R^2$ and $X^1$ to $X^3$ may be bound to each other to form a ring.

Preferably, the photothermographic material of the present invention further contains (f) a phthalazine compound represented by the following formula (3).

(3)

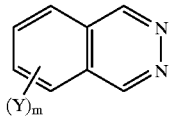

In the formula (3), Y represents hydrogen atom or a monovalent substituent, and m represents an integer of 1 to 6. (Y)m means that 1–6 of Y independently exist on the phthalazine ring, and when m is 2 or more, adjacent two of Y may form an aliphatic ring, an aromatic ring or a heterocycle.

Preferably, in the formula (2), at least one of $X^1$ to $X^3$ is a halogen atom, an alkoxy group, an aryloxy group, a heteroaryloxy group, an alkylthio group, an arylthio group, a heterocyclylthio group or a nitrogen-containing heterocyclic group that binds to the phenol ring via nitrogen atom.

Preferably, the photothermographic material of the present invention further contains an ultrahigh contrast agent.

Preferably, the photothermographic material of the present invention is prepared by using an aqueous coating solution.

In the present specification, ranges indicated with "-" mean ranges including the numerical values before and after "-" as the minimum and maximum values.

The photothermographic material of the present invention has photographic properties suitable for photographic art, i.e., high sensitivity and high Dmax (maximum density) as well as low fog.

PREFERRED EMBODIMENTS OF THE INVENTION

Figure 1:
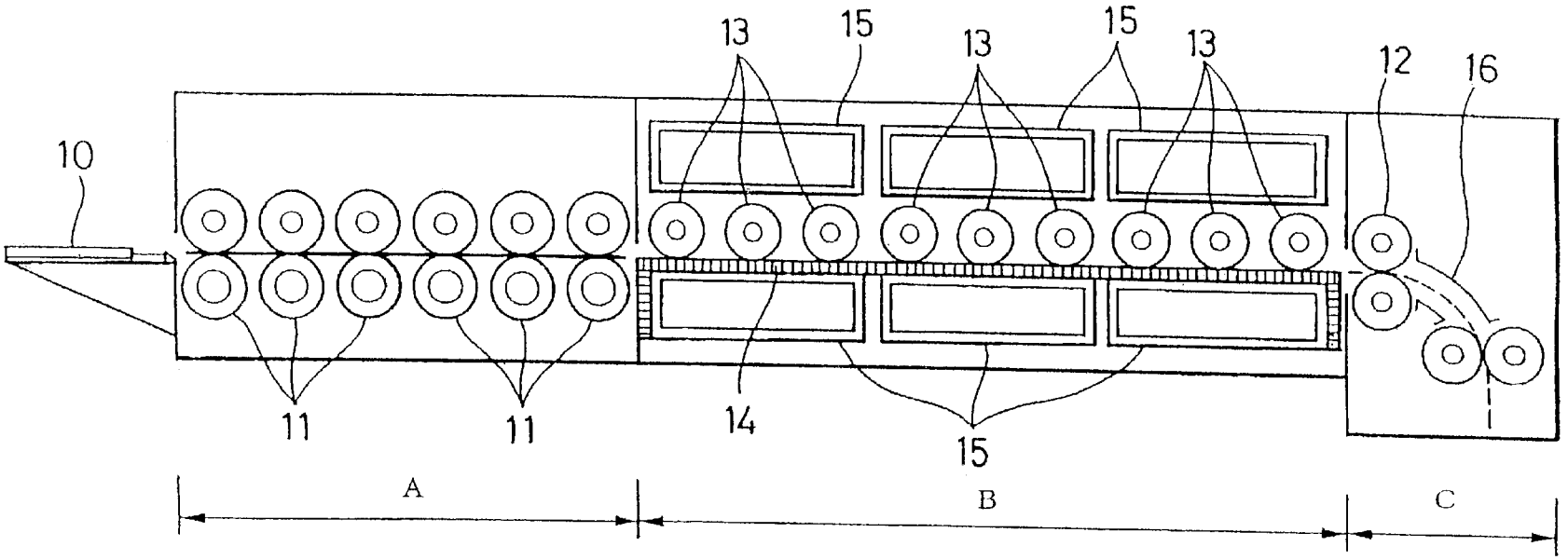
FIG. 1 is a side view of an exemplary heat development apparatus used for heat development of the photothermographic material of the present invention. In the figure, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The photothermographic material of the present invention will be explained in detail hereafter.

The photothermographic material of the present invention comprises an image-forming layer containing a silver salt of an organic acid, which is a reducible silver salt, and a binder, and a photosensitive silver halide emulsion layer (photosensitive layer) containing a photosensitive silver halide on the same side of a support. The image-forming layer preferably contains a photosensitive silver halide to also serve as a photosensitive layer. The photothermographic material of the present invention further comprises a particular bisphenol compound and a particular phenol compound on the image-forming layer side, and thus it becomes a photothermographic material for photographic art which shows high sensitivity, high Dmax (maximum density) and low fog and can provide images suitable for photographic art.

The photothermographic material of the present invention comprises a reducing agent represented by the aforementioned formula (1) on the same side of a support as the photosensitive silver halide and the reducible silver salt.

In the formula (1), $V^1$ to $V^8$ each independently represent hydrogen atom or a substituent. The substituents represented by $V^1$ to $V^8$ may be the same or different from each other or one another. Preferred examples of the substituents include a halogen atom (for example, fluorine atom, chlorine atom, bromine atom and iodine atom), a linear, branched or cyclic alkyl group having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), an ureido group having preferably 1–20 carbon atoms, more preferably 1–16 carbon atoms, further preferably 1–12 carbon atoms (forexample, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), a sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl, etc.), a cyano group, a nitro group, a mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituents represented by $V^1$ to $V^8$ are alkyl groups (for example, methyl, ethyl, n-propyl, isopropyl, sec-butyl, tert-butyl, tert-octyl, n-amyl, tert-amyl, n-dodecyl, n-tridecyl, cyclohexyl etc.).

In the formula (1), L represents a bridging group consisting of —CH($V^9$)— or —S—. $V^9$ represents hydrogen atom or a substituent. Preferred examples of the substituent represented by $V^9$ include, for example, a halogen atom (for example, fluorine atom, chlorine atom, bromine atom and iodine atom), a linear, branched or cyclic alkyl group having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl, 2,4,4-trimethylpentyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), an ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), a carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), a sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl, etc.), a cyano group, a nitro group, a hydroxyl group, a mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituent represented by $V^9$ are an alkyl group (for example, methyl, ethyl, n-propyl, isopropyl, sec-butyl, tert-butyl, tert-octyl, n-amyl, n-octyl, tert-amyl, n-dodecyl, n-tridecyl, cyclohexyl, 2,4,4-trimethylpentyl etc.), an alkenyl group (for example, vinyl, allyl, 2-butenyl, 3-pentenyl etc.), an aryl group (for example, phenyl, p-methylphenyl, naphthyl etc.), a hydroxyl group, a mercapto group, an alkylthio group (for example, methylthio, butylthio etc.) and so forth.

Specific examples of the reducing agent represented by the formula (1) are shown below. However, the reducing agent used for the present invention is not limited to these examples.

(I-1)
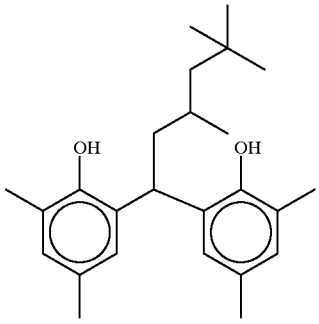
(I-2)
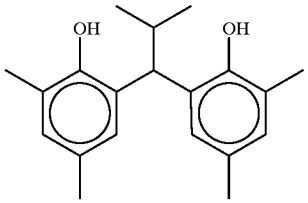
(I-3)
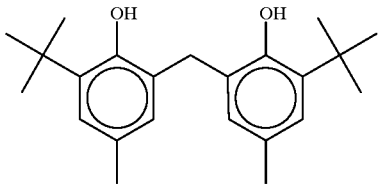
(I-4)
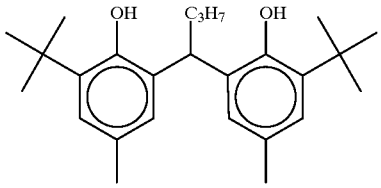
(I-5)
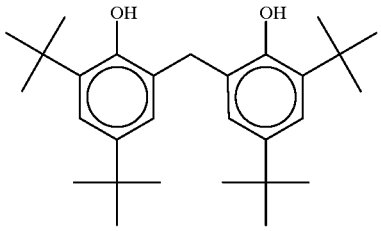
(I-6)
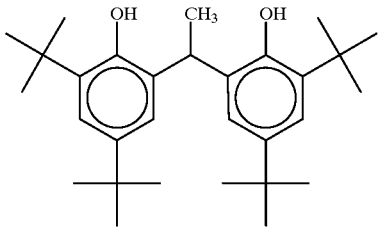
-continued
(I-7)
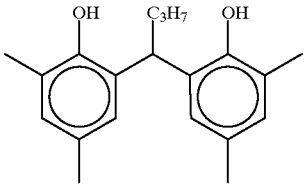
(I-8)
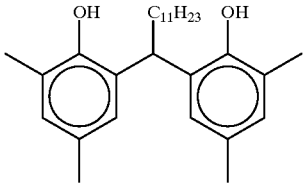
(I-9)
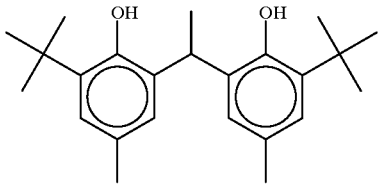
(I-10)
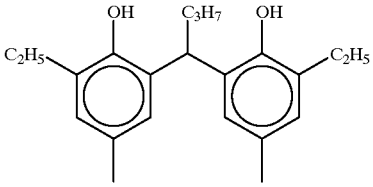
(I-11)
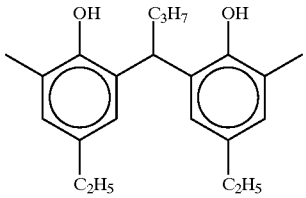
(I-12)
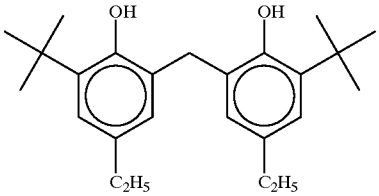
(I-13)
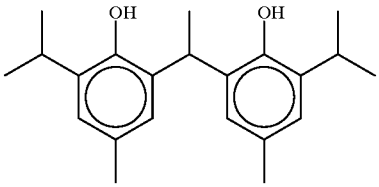

-continued
(I-14)
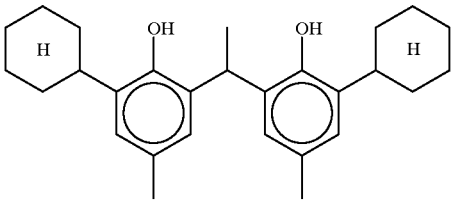
(I-15)
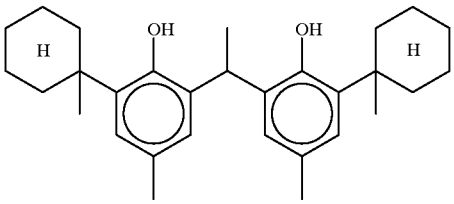
(I-16)
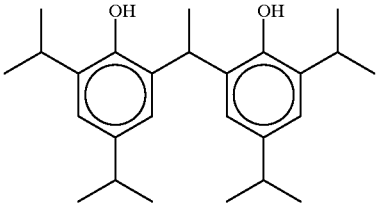
(I-17)
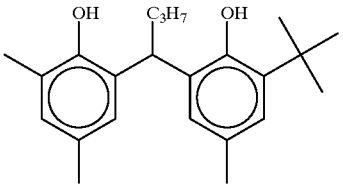
(I-18)
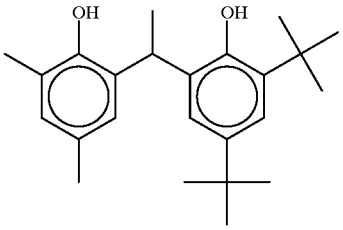
(I-19)
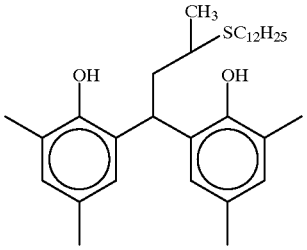
-continued
(I-20)
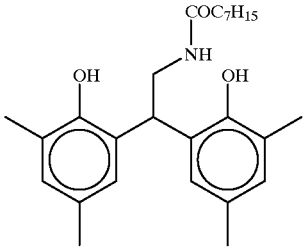
(I-21)
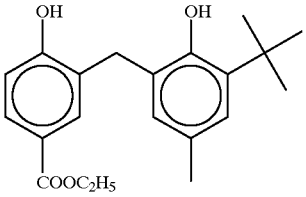
(I-22)
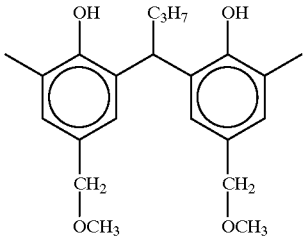
(I-23)
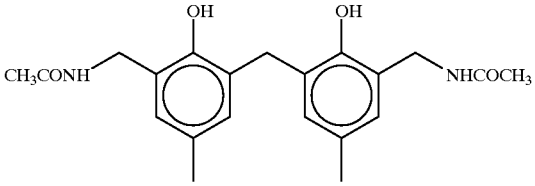
(I-24)
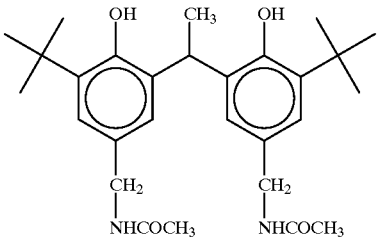
(I-25)
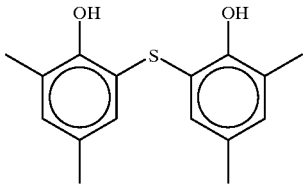

-continued (I-26)

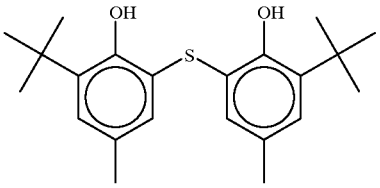

(I-27)

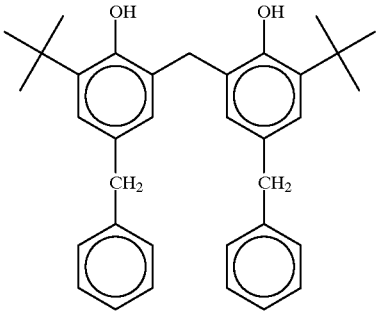

(I-28)

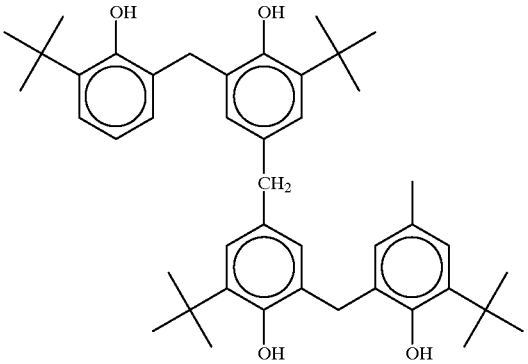

(I-29)

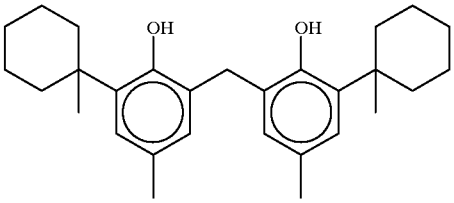

(I-30)

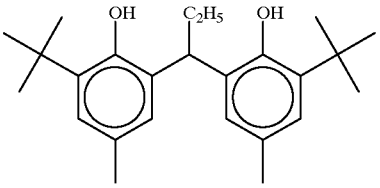

(I-31)

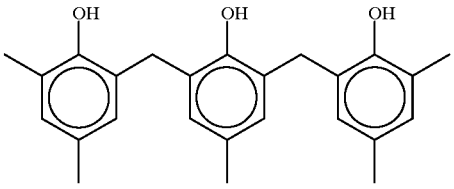

-continued (I-32)

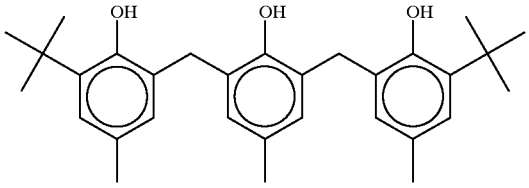

(I-33)

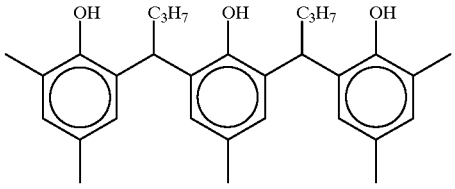

(I-34)

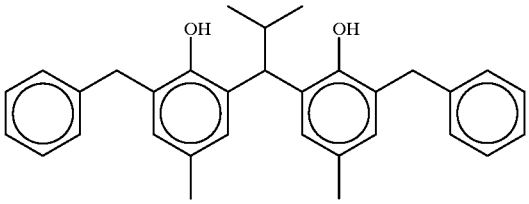

The amount of the bisphenol compound represented by the formula (1) is preferably 0.01 to 4.0 g, more preferably 0.2 to 2.0 g, further preferably 0.5 to 2.0 g, per 1 $m^2$ of the photosensitive material. Further, it is preferably contained in an amount of 2 to 40 moles %, more preferably 5 to 30 moles % per mole of silver present on the side having the image-forming layer.

The bisphenol compound represented by the formula (1) may be added in any form, for example, as a solution, powder, solid microparticle dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The bisphenol compound represented by the formula (1) may be added to any layer provided on the same side on a support as the aforementioned photosensitive silver halide and the reducible silver salt. However, it is preferably added to a layer containing the silver halide or a layer adjacent thereto.

The photothermographic material of the present invention comprises a phenol compound represented by the aforementioned formula (2) on the same side of a support as the photosensitive silver halide and the reducible silver salt. As the phenol compound represented by the formula (2), phenol couplers or naphthol couplers known in the field of photography can also be used.

In the formula (2), $R^1$ and $R^2$ each independently represent hydrogen atom or a substituent. The substituents represented by $R^1$ and $R^2$ may be the same or different from each other. Specific examples thereof include those substituents mentioned as examples of $V^1$ to $V^8$ in the formula (1). These substituents may be further substituted with other substituents.

Preferred examples of the substituents represented by $R^1$ and $R^2$ are a halogen atom, an alkyl group, an aryl group, an alkoxy group, an aryloxy group, an acyloxy group, an anilino group, an acylamino group, a sulfonylamino group, carboxyl group, a carbamoyl group, an acyl group, a sulfo group, a sulfonyl group, a sulfamoyl group, a cyano group, a mercapto group, an alkylthio group and a heterocyclic group.

In the formula (2), $X^1$ to $X^3$ each independently represent hydrogen atom or a substituent, provided that the substituents represented by $X^1$ to $X^3$ do not represent hydroxy group, and when the substituents represented by $X^1$ to $X^3$ are bonded to the phenol ring via nitrogen atoms, $X^1$ to $X^3$ represent a nitrogen-containing heterocyclic group or a group represented as —NH—C(=O)—$R^4$ where $R^4$ represents a substituent having 8–40 carbon atoms. The substituents represented by $R^1$, $R^2$ and $X^1$ to $X^3$ may be bound to each other to form a ring.

The substituents represented by $X^1$ to $X^3$ may be the same or different from one another. Specific examples thereof include those substituents mentioned as examples of $V^1$ to $V^8$ in the formula (1).

When the substituents represented by $X^1$ to $X^3$ represents a group represented as —NH—C(=O)—$R^4$, this group is preferably a substituent called ballast group in known phenol couplers.

As for the substituents represented by $X^1$ to $X^3$, at least one of $X^1$ to $X^3$ is preferably a halogen atom, an alkoxy group, an aryloxy group, a heteroaryloxy group, an alkylthio group, an arylthio group, a heterocyclylthio group or a nitrogen-containing heterocyclic group that binds to the phenol ring via nitrogen atom. Preferred examples of the substituents include a halogen atom (for example, fluorine atom, chlorine atom, bromine atom and iodine atom), an alkoxy group having preferably 1–20 carbon atoms, more preferably 1–12 carbon atoms, further preferably 1–8 carbon atoms (for example, methoxy, ethoxy, butoxy etc.), an aryloxy group having preferably 6–20 carbon atoms, more preferably 6–16 carbon atoms, further preferably 6–12 carbon atoms (for example, phenyloxy, 2-naphthyloxy etc.), a heteroaryloxy group (for example, 2-pyridyloxy group, 2-thiophenyloxy group etc.), an alkylthio group having preferably 1–20 carbon atoms, more preferably 1–16 carbon atoms, further preferably 1–12 carbon atoms (for example, methylthio, ethylthio, butylthio etc.), an arylthio group having preferably 6–20 carbon atoms, more preferably 6–16 carbon atoms, further preferably 6–12 carbon atoms (for example, phenylthio, naphthylthio etc.), a heterocyclylthio group (for example, tetrazolylthio group, triazolylthio group etc.) or a nitrogen-containing heterocyclic group that binds to the phenol ring via nitrogen atom (for example, benzotriazolyl group, pyrazolyl group, imidazolyl group, benzimidazolyl group, tetrazolyl group, triazolyl group etc.). Further, substituents called leaving groups contained in coupler compounds generally used for photosensitive materials for color photography may also be preferably used. These substituents may be further substituted with other substituents, and these substituents may be any of generally known substituents that do not degrade photographic performance.

When the substituents represented by $R^1$, $R^2$ and $X^1$ to $X^3$ are bonded to each other to form a ring, preferred examples of the formed condensed ring include a benzo-type condensed ring, naphtha-type condensed ring and so forth. The ring formed by bonding of the substituents represented by $R^1$, $R^2$ and $X^1$ to $X^3$ may be further substituted with one or more substituents.

Specific examples of the phenol compound represented by the formula (2) are shown below. However, the scope of the phenol compound used for the present invention is not limited to these examples.

(II-1)

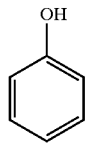

(II-2)

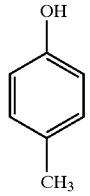

(II-3)

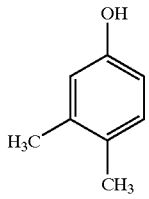

(II-4)

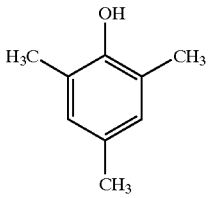

(II-5)

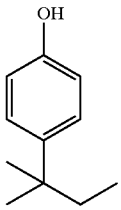

(II-6)

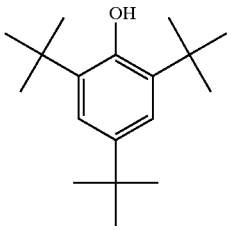

(II-7)

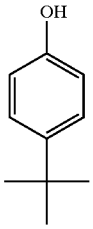

-continued
(II-8)
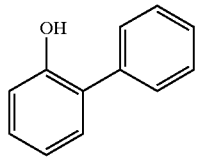
(II-9)
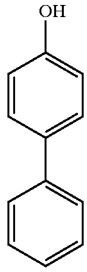
(II-10)
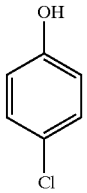
(II-11)
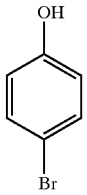
(II-12)
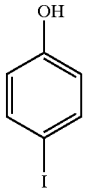
(II-13)
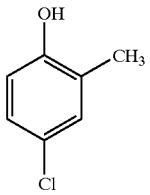
(II-14)
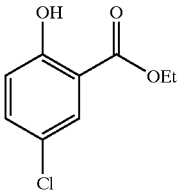
-continued
(II-15)
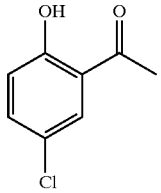
(II-16)
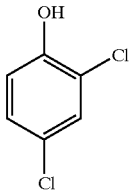
(II-17)
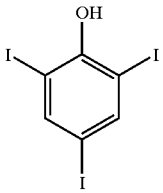
(II-18)
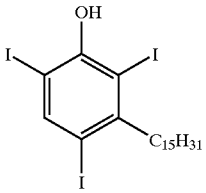
(II-19)
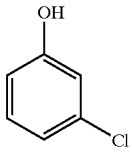
(II-20)
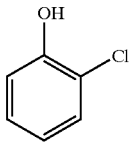
(II-21)
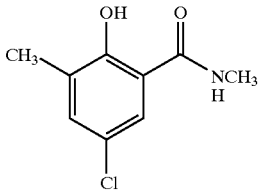
(II-22)
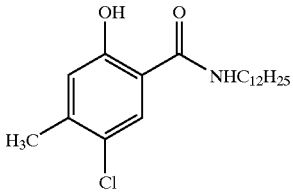

-continued
(II-23)
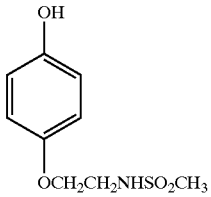
(II-24)
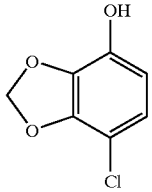
(II-25)
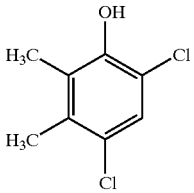
(II-26)
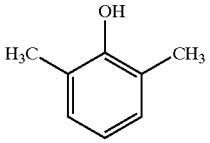
(II-27)
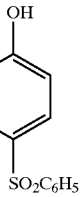
(II-28)
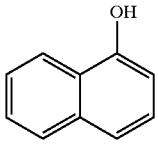
(II-29)
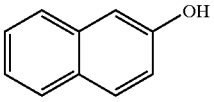
(II-30)
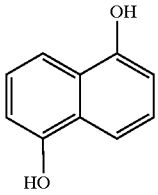
(II-31)
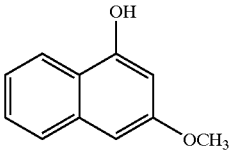
-continued
(II-32)
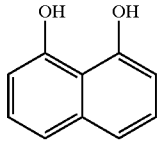
(II-33)
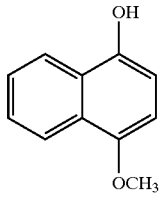
(II-34)
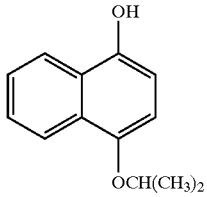
(II-35)
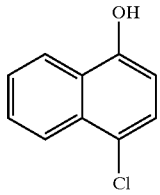
(II-36)
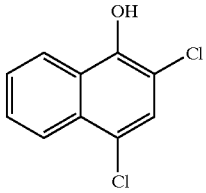
(II-37)
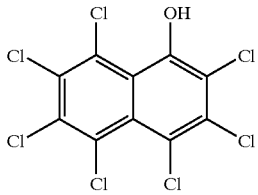
(II-38)
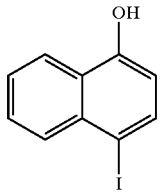
(II-39)
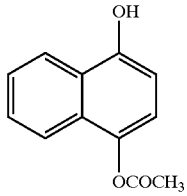

-continued
(II-40)
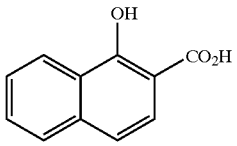
(II-41)
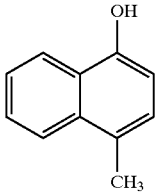
(II-42)
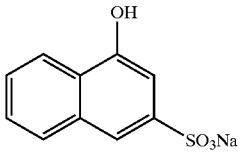
(II-43)
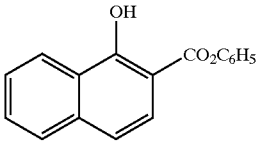
(II-44)
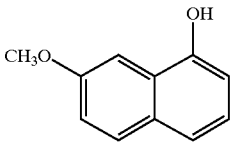
(II-45)
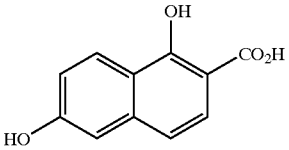
(II-46)
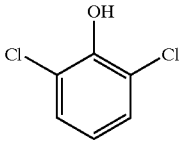
(II-47)
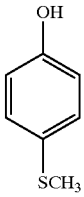
(II-48)
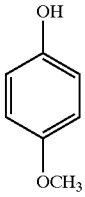
-continued
(II-49)
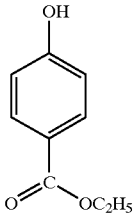
(II-50)
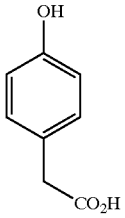
(II-51)
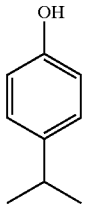
(II-52)
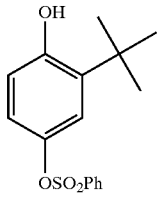
(II-53)
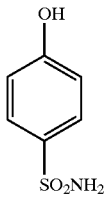
(II-54)
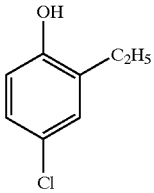
(II-55)
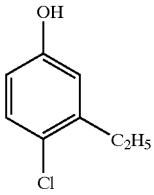

-continued
(II-56)
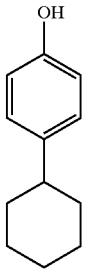
(II-57)
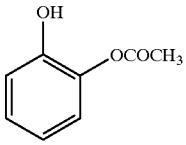
(II-58)
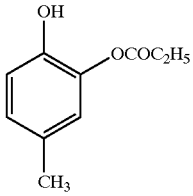
(II-59)
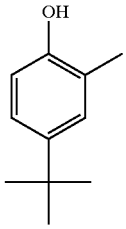
(II-60)
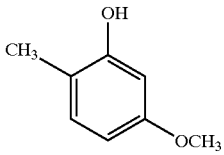
(II-61)
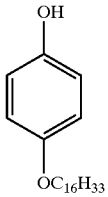
(II-62)
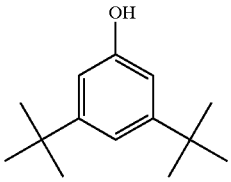
(II-63)
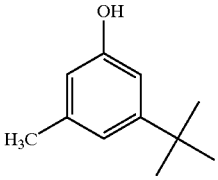
-continued
(I--64)
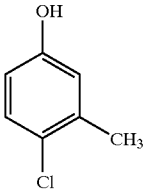
(II-65)
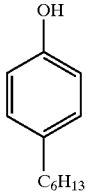
(II-66)
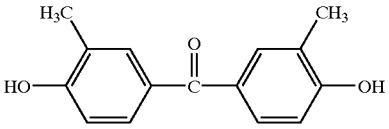
(II-67)
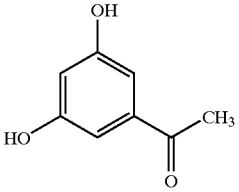
(II-68)
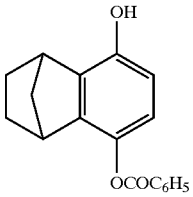
(II-69)
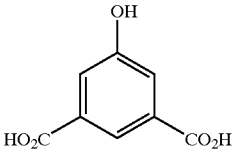
(II-70)
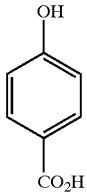
(II-71)
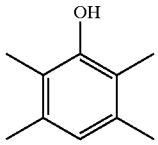
(II-72)
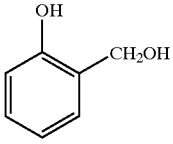

-continued
(II-73)
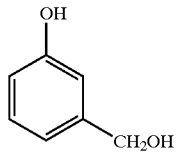
(II-74)
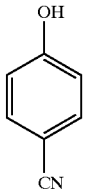
(II-75)
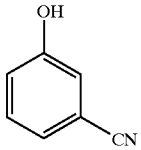
(II-76)
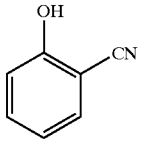
(II-77)
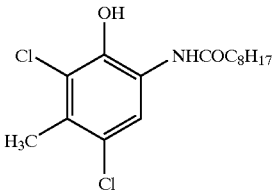
(II-78)
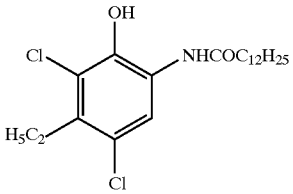
(II-79)
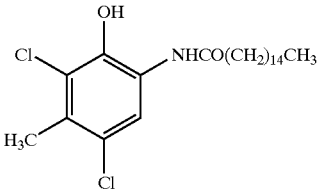
(II-80)
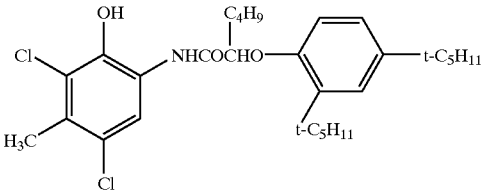
-continued
(II-81)
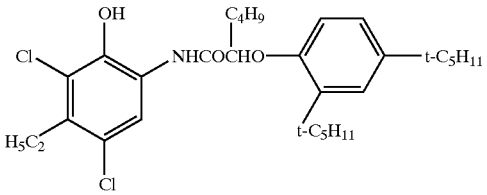
(II-82)
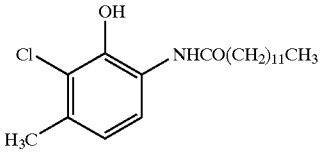
(II-84)
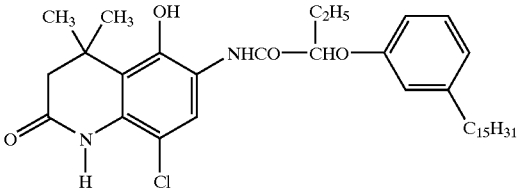
(II-85)
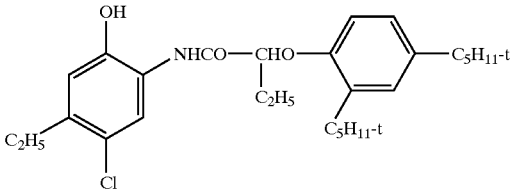
(II-87)
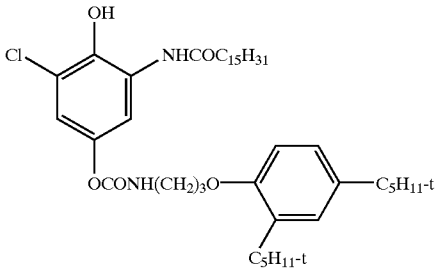
(II-88)
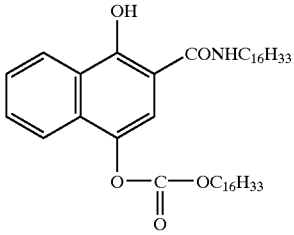
(II-89)
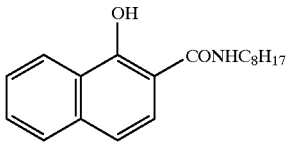

-continued
(II-90)
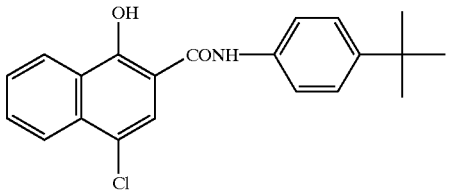
(II-91)
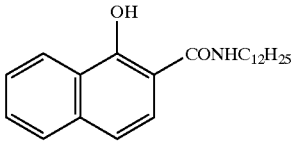
(II-92)
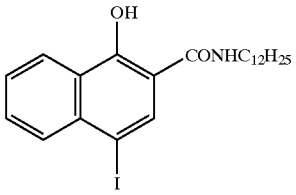
(II-93)
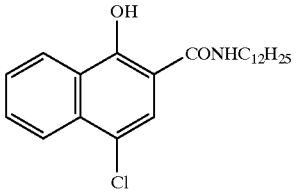
(II-94)
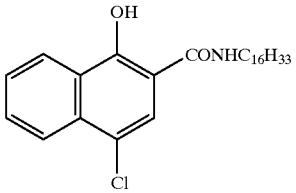
(II-95)
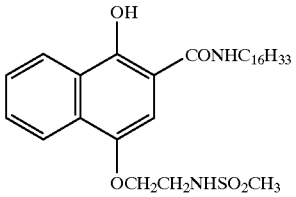
(II-96)
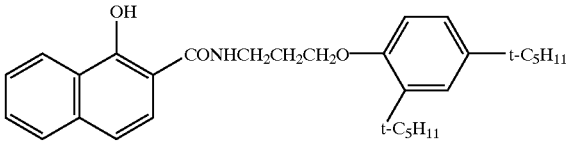
(II-97)
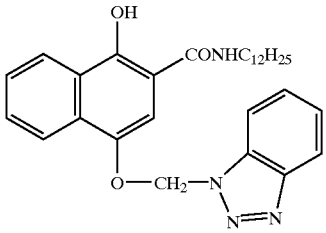
-continued
(II-98)
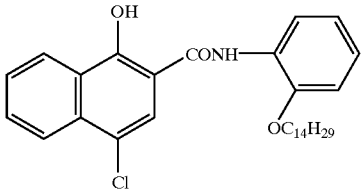
(II-99)
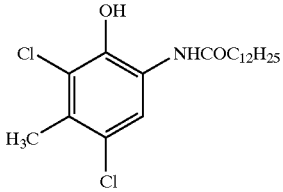
(II-100)
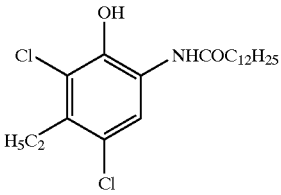
(II-101)
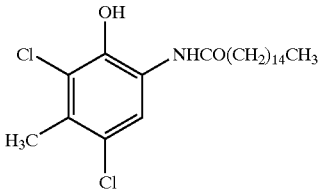
(II-102)
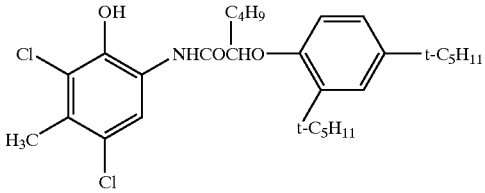
(II-103)
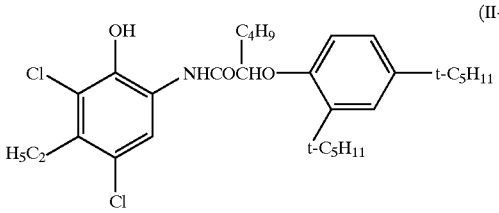
(II-104)
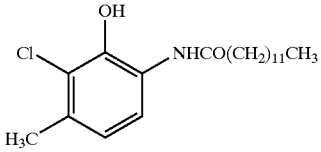
(II-105)
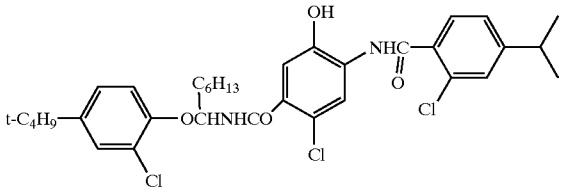

-continued
(II-106)
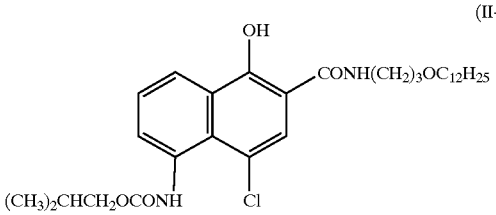
(II-107)
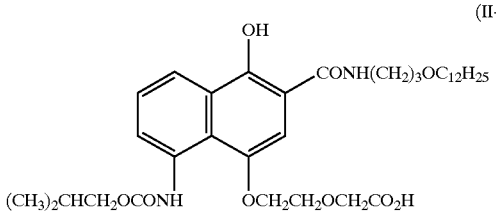
(II-108)
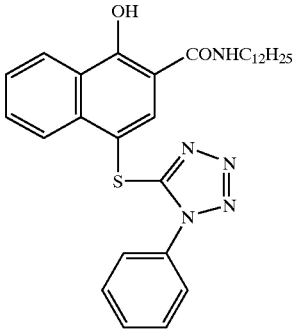
(II-109)
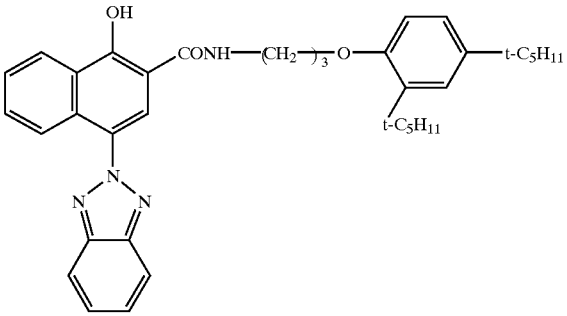
(II-110)
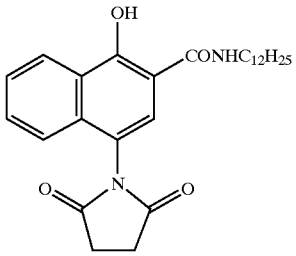
-continued
(II-111)
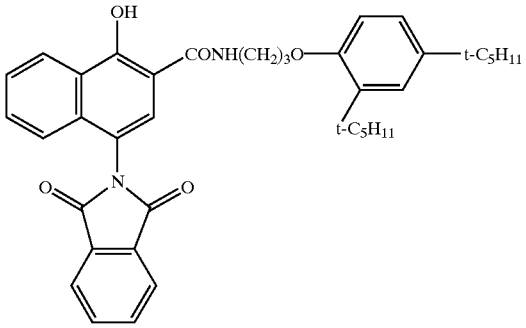
(II-112)
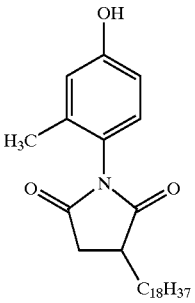
(II-113)
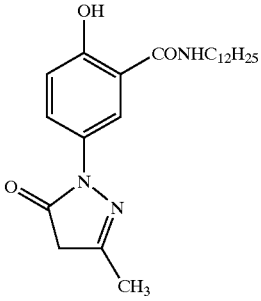
(II-114)
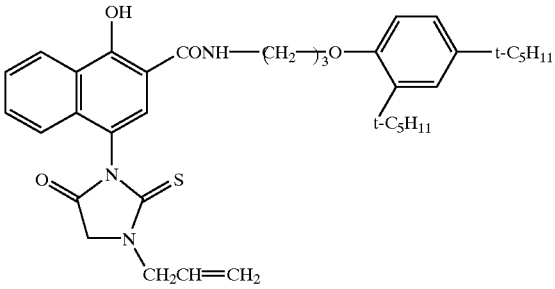
(II-115)
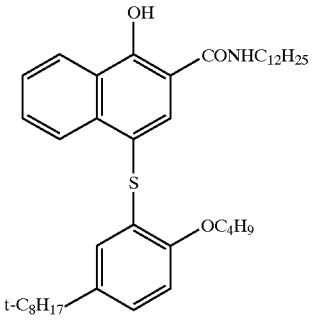

-continued (II-116)

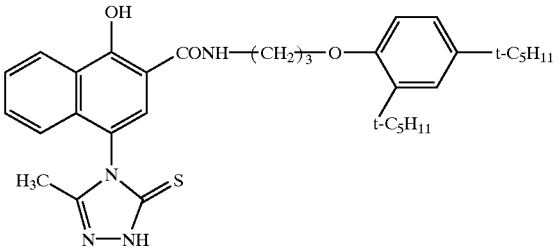

(II-117)

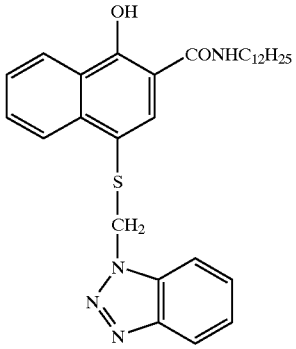

(II-118)

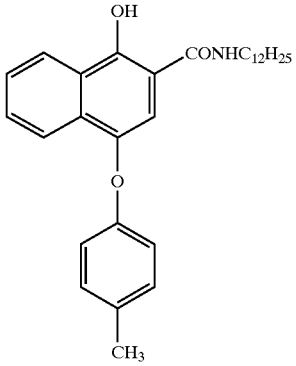

The phenol compounds represented by the formula (2) can be readily synthesized by the methods known in the field of photography.

The amount of the phenol compound represented by the formula (2) is preferably 0.001 to 4.0 g, more preferably 0.01 to 2.0 g, further preferably 0.1 to 2.0 g, per 1 $m^2$ of the photosensitive material. Further, it is preferably contained in an amount of 0.1–1000 mole %, more preferably 1–100 mole %, further preferably 5–50 mole %, with respect to the reducing agent represented by the formula (1). The phenol compounds represented by the formula (2) may be used each alone, or as a combination of two or more of them.

The phenol compounds represented by the formula (2) may be used after being dissolved in water or an appropriate organic solvent such as alcohols (e.g., methanol, ethanol, propanol, fluorinated alcohol etc.), ketones (e.g., acetone, methyl ethyl ketone etc.), dimethylformamide, dimethyl sulfoxide or methyl cellosolve. Further, they may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, they may be used by dispersing powder of the phenol compounds represented by the formula (2) in water by using a ball mill, colloid mill, sand grinder mill, MANTON GAULIN, microfluidizer, or by means of ultrasonic wave according to a known method for solid dispersion.

While the phenol compound represented by the formula (2) may be added to any layer on the same side of a support as the aforementioned photosensitive silver halide and reducible silver salt, it is preferably added to a layer containing silver halide or a layer adjacent thereto.

The photothermographic material of the present invention may contain a compound called "color tone adjuster" if required in order to improve image density of silver images, color tone of silver and heat developability.

For the photothermographic material using a silver salt of an organic acid, color tone adjusters of a wide range have been disclosed. For example, there can be mentioned color tone adjusters disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and 4,510,236, British Pat. No. 1,380,795, Belgian Pat. No. 841,910, JP-B-1-25050 and so forth.

Specific examples of the color tone adjuster include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylid ene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride, homophthalic acid); phthalazine, phthalazine derivatives (e.g., 4-(1-naphthyl)phthalazine, 6-chlorophthalazine, 5,7-dimethoxyphthalazine, 6-isopropylphthalazine, 6-isobutylphthalazine, 6-tert-butylphthalazine, 5,7-dimethylphthalazine, 2,3-dihydrophthalazine) and metal salts thereof; combinations of phthalazine or a derivative thereof and a phthalic acid derivative (e.g., phthalic acid, 4-methylphthalic acid, 4-nitrophthalic acid, tetrachlorophthalic acid anhydride, homophthalic acid etc.); quinazolinedione, benzoxazine and naphthoxazine derivatives; rhodium complexes which function not only as a color tone adjuster but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetra-azapentalene and so forth.

The color tone adjusters have been searched in view of desired performances (image density, silver color tone, improvement of heat developability), properties for volatilization, sublimation or the like from photosensitive materials, properties of photosensitive materials comprising them in combination with other additives such as antifoggants, and many color tone adjusters have been reported. It is known that, among those, superior results can be obtained by combinations of phthalazine compounds represented by the aforementioned formula (3) and phthalic acid derivatives.

When the photothermographic material of the present invention contains an additive known as a "color tone adjuster" capable of improving images, optical density may increase in some cases. The color tone adjuster may also be advantageous for forming black silver images. The color tone adjuster is preferably contained in a layer on the side having the image-forming layer in an amount of 0.1–50 moles %, more preferably 0.5–20 moles %, per mole of silver. The color tone adjuster may be a so-called precursor that is derived to effectively function only at the time of development.

The photothermographic material of the present invention preferably further contains a phthalazine compound represented by the formula (3). In the formula (3), Y represents hydrogen atom or a monovalent substituent, and m represents an integer of 1 to 6. That is, (Y)m means that 1–6 of Y independently exist on the phthalazine ring, and when m is 2 or more, adjacent two of Y may form an aliphatic ring, aromatic ring or heterocycle.

Examples of the substituents represented by Y include, for example, an alkyl group having preferably from 1 to 20 carbon atoms, more preferably from 1 to 12 carbon atoms, further preferably from 1 to 8 carbon atoms (for example, methyl, ethyl, n-propyl, iso-propyl, n-butyl, iso-butyl, tert-butyl, n-octyl, n-decyl, n-hexadecyl, cyclopropyl, cyclopentyl, cyclohexyl, etc.); an alkenyl group preferably having from 2 to 20 carbon atoms, more preferably from 2 to 12 carbon atoms, further preferably from 2 to 8 carbon atoms (for example, vinyl, allyl, 2-butenyl, 3-pentenyl etc.); an alkynyl group preferably having from 2 to 20 carbon atoms, more preferably from 2 to 12 carbon atoms, further preferably from 2 to 8 carbon atoms (for example, propargyl, 3-pentynyl etc.); an aryl group preferably having from 6 to 30 carbon atoms, more preferably from 6 to 20 carbon atoms, further preferably from 6 to 12 carbon atoms (for example, phenyl, p-methylphenyl, naphthyl etc.); an aralkyl group preferably having from 7 to 30 carbon atoms, more preferably from 7 to 20 carbon atoms, further preferably from 7 to 12 carbon atoms, particularly preferably from 7 to 8 carbon atoms (for example, benzyl, α-methylbenzyl, 2-phenylethyl, naphthylmethyl, (4-methylphenyl)methyl etc.); an amino group preferably having from 0 to 20 carbon atoms, more preferably from 0 to 10 carbon atoms, further preferably from 0 to 6 carbon atoms (for example, amino, methylamino, dimethylamino, diethylamino, dibenzylamino etc.); an alkoxy group preferably having from 1 to 20 carbon atoms, more preferably from 1 to 12 carbon atoms, particularly preferably from 1 to 8 carbon atoms (for example, methoxy, ethoxy, butoxy etc.); an aryloxy group preferably having from 6 to 20 carbon atoms, more preferably from 6 to 16 carbon atoms, further preferably from 6 to 12 carbon atoms (for example, phenyloxy, 2-naphthyloxy etc.); an acyl group preferably having from 1 to 20 carbon atoms, more preferably from 1 to 16 carbon atoms, further preferably from 1 to 12 carbon atoms (for example, acetyl, benzoyl, formyl, pivaloyl etc.); an alkoxycarbonyl group preferably having from 2 to 20 carbon atoms, more preferably from 2 to 16 carbon atoms, further preferably from 2 to 12 carbon atoms (for example, methoxycarbonyl, ethoxycarbonyl etc.); an aryloxycarbonyl group preferably having from 7 to 20 carbon atoms, more preferably from 7 to 16 carbon atoms, further preferably from 7 to 10 carbon atoms (for example, phenyloxycarbonyl etc.); an acyloxy group preferably having from 2 to 20 carbon atoms, more preferably from 2 to 16 carbon atoms, further preferably from 2 to 10 carbon atoms (for example, acetoxy, benzoyloxy etc.); an acylamino group preferably having from 2 to 20 carbon atoms, more preferably from 2 to 16 carbon atoms, further preferably from 2 to 10 carbon atoms (for example, acetylamino, benzoylamino etc.); an alkoxycarbonylamino group preferably having from 2 to 20 carbon atoms, more preferably from 2 to 16 carbon atoms, further preferably from 2 to 12 carbon atoms (for example, methoxycarbonylamino etc.); an aryloxycarbonylamino group preferably having from 7 to 20 carbon atoms, more preferably from 7 to 16 carbon atoms, further preferably from 7 to 12 carbon atoms (for example, phenyloxycarbonylamino etc.); a sulfonylamino group preferably having from 1 to 20 carbon atoms, more preferably from 1 to 16 carbon atoms, further preferably from 1 to 12 carbon atoms (for example, methanesulfonylamino, benzenesulfonylamino etc.); a sulfamoyl group preferably having from 0 to 20 carbon atoms, more preferably from 0 to 16 carbon atoms, further preferably from 0 to 12 carbon atoms (for example, sulfamoyl, methylsulfamoyl, dimethylsulfamoyl, phenylsulfamoyl etc.); a carbamoyl group preferably having from 1 to 20 carbon atoms, more preferably from 1 to 16 carbon atoms, further preferably from 1 to 12 carbon atoms (for example, carbamoyl, methylcarbamoyl, diethylcarbamoyl, phenylcarbamoyl etc.); an alkylthio group preferably having from 1 to 20 carbon atoms, more preferably from 1 to 16 carbon atoms, further preferably from 1 to 12 carbon atoms (for example, methylthio, ethylthio etc.); an arylthio group preferably having from 6 to 20 carbon atoms, more preferably from 6 to 16 carbon atoms, further preferably from 6 to 12 carbon atoms (for example, phenylthio etc.); a sulfonyl group preferably having from 1 to 20 carbon atoms, more preferably from 1 to 16 carbon atoms, further preferably from 1 to 12 carbon atoms (for example, mesyl, tosyl etc.); a sulfinyl group preferably having from 1 to 20 carbon atoms, more preferably from 1 to 16 carbon atoms, further preferably from 1 to 12 carbon atoms (for example, methanesulfinyl, benzenesulfinyl etc.); an ureido group preferably having from 1 to 20 carbon atoms, more preferably from 1 to 16 carbon atoms, further preferably from 1 to 12 carbon atoms (for example, ureido, methylureido, phenylureido etc.); a phosphoric acid amido group preferably having from 1 to 20 carbon atoms, more preferably from 1 to 16 carbon atoms, further preferably from 1 to 12 carbon atoms (for example, diethylphosphoric acid amido, phenylphosphoric acid amido etc.); a hydroxyl group; a mercapto group; a halogen atom (e.g., fluorine atom, chlorine atom, bromine atom, iodine atom); a cyano group; a sulfo group; a carboxyl group; a nitro group; a hydroxamic acid group; a sulfino group; a hydrazino group; a heterocyclic group (e.g., imidazolyl, pyridyl, furyl, piperidyl, morpholino etc.) ad so forth. These substituents may be further substituted with other substituents.

Y is preferably hydrogen atom, an alkyl group, an alkenyl group, an alkynyl group, an aryl group, an aralkyl group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a sulfinyl group, a hydroxy group, a halogen atom or a cyano group, more preferably hydrogen atom, an alkyl group, an aryl group, an aralkyl group, an acyl group, a hydroxy group, a halogen atom, or a cyano group, further preferably hydrogen atom, an alkyl group, an aryl group, an aralkyl group or a halogen atom, particularly preferably hydrogen atom, an alkyl group, an aryl group or an aralkyl group.

m represents an integer of 1 to 6. m is preferably 3 or less, more preferably 2 or less. When m is 2 or more, adjacent two of Ymay forman aliphatic ring (preferably 3-to 8-membered, more preferably 5- or 6-membered), an aromatic ring (preferably benzene or naphthalene) or a heterocycle (preferably 5- or 6-membered ring).

As for the methods for producing the phthalazine compounds represented by the formula (3), there can be mentioned, for example, the method comprising condensing a corresponding phthalic acid derivative (phthalaldehyde, phthalic acid anhydride, phthalic ester etc.) with hydrazine to form a phthalazine base structure as described in R. G. ElderField "Heterocyclic Compounds", John Wiley and Sons, Vols. 1–9, 1950–1967, and A. R. Katritzky, "Comprehensive Heterocyclic Chemistry", Pergamon Press, 1984 etc., the method comprising condensing α,α,α',α'-tetrachloro-o-xylene with hydrazine to form a phthalazine, the method comprising reacting an arylaldazine derivative with a mixture of aluminum chloride and aluminum bromide under a condition where the materials are melted to cause cyclization as described in Tetrahedron Letters, vol. 22, 345 page (1981), the method in which the synthesis is attained by cyclization of an aldazine compound in an organic solvent using an aluminum chloride catalyst as described in JP-A-11-180961 and so forth.

Specific examples of the phthalazine compounds represented by the formula (3) are listed below. However, the phthalazine compounds used for the present invention are not limited to these.

(III-1)

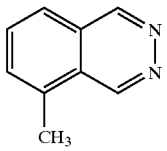

(III-2)

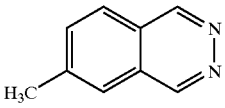

-continued (III-3)

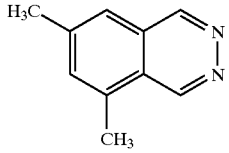

(III-4)

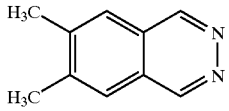

(III-5)

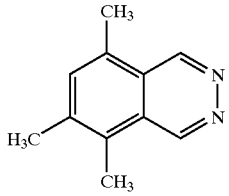

(III-6)

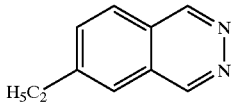

(III-7)

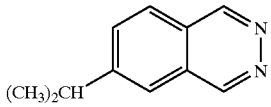

(III-8)

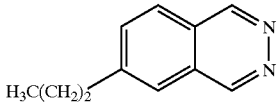

(III-9)

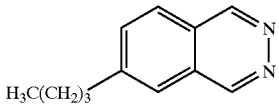

(III-10)

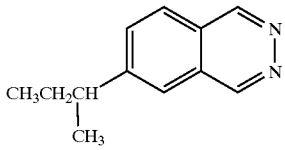

(III-11)

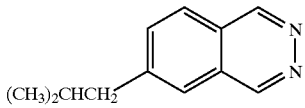

(III-12)

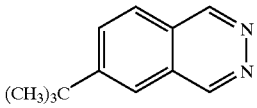

(III-13)

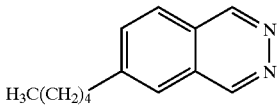

(III-14)

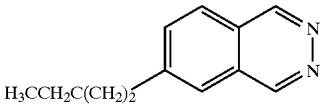

-continued
(III-15)
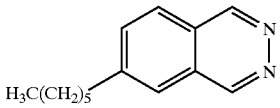
(III-16)
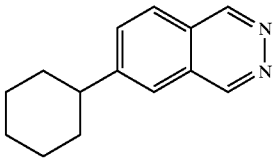
(III-17)
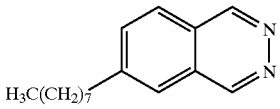
(III-18)
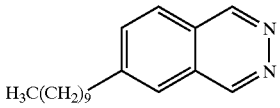
(III-19)
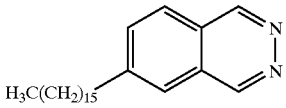
(III-20)
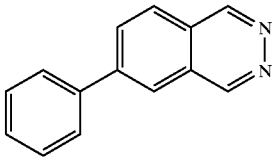
(III-21)
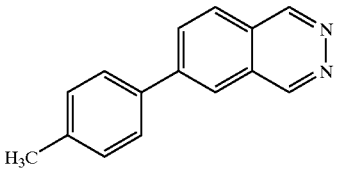
(III-22)
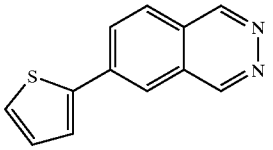
(III-23)
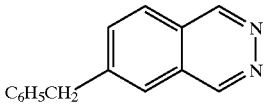
(III-24)
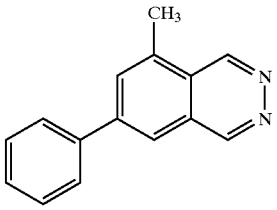
(III-25)
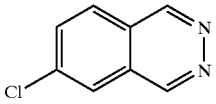
-continued
(III-26)
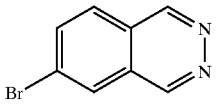
(III-27)
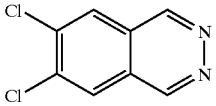
(III-28)
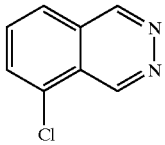
(III-29)
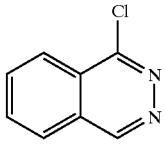
(III-30)
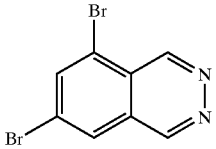
(III-31)
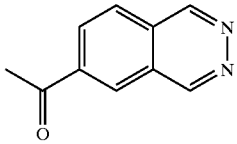
(III-32)
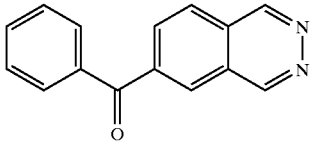
(III-33)
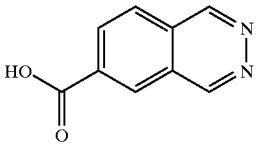
(III-34)
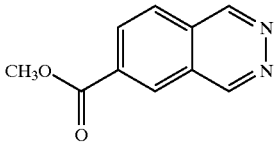
(III-35)
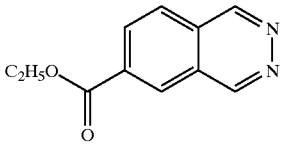
(III-36)
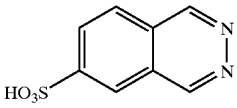

-continued
(III-37)
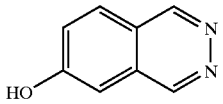
(III-38)
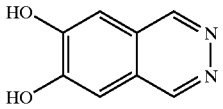
(III-39)
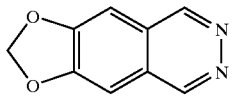
(III-40)
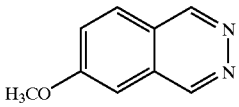
(III-41)
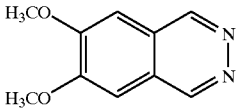
(III-42)
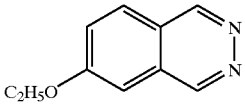
(III-43)
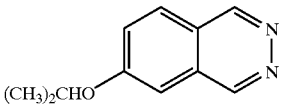
(III-44)
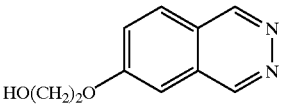
(III-45)
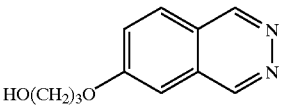
(III-46)
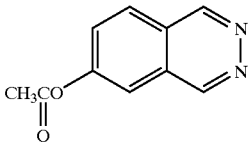
(III-47)
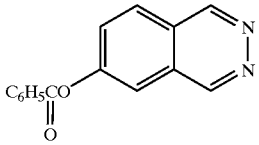
(III-48)
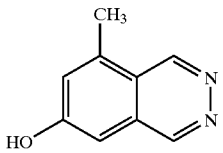
-continued
(III-49)
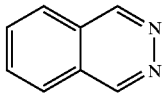
(III-50)
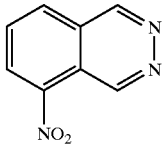
(III-51)
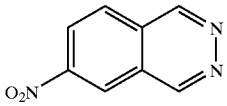
(III-52)
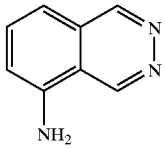
(III-53)
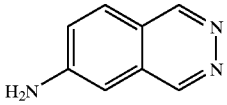
(III-54)
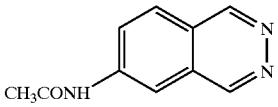
(III-55)
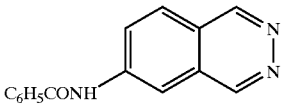
(III-56)
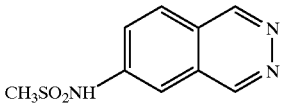
(III-57)
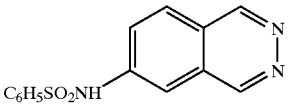
(III-58)
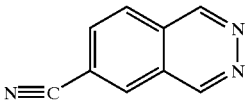
(III-59)
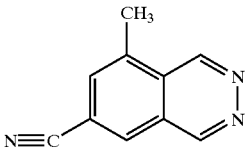
(III-60)
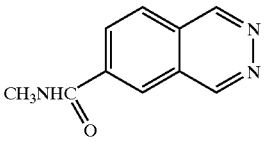

-continued
(III-61)
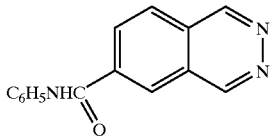
(III-62)
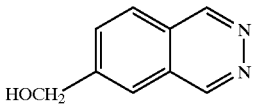
(III-63)
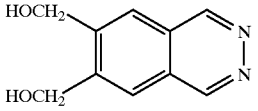
(III-64)
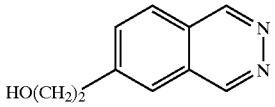
(III-65)
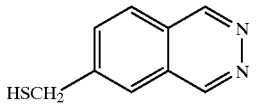
(III-66)
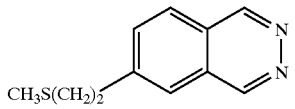
(III-67)
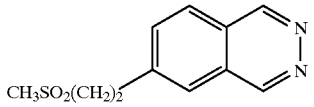
(III-68)
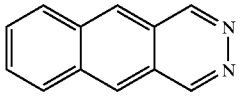
(III-69)
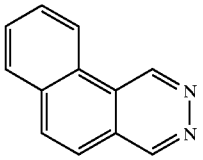
(III-70)
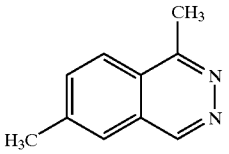
(III-71)
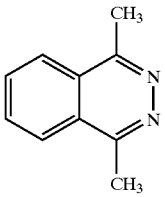
-continued
(III-72)
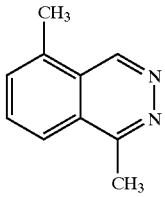
(III-73)
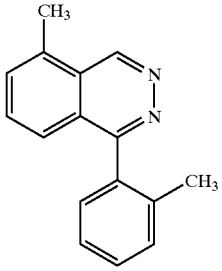
(III-74)
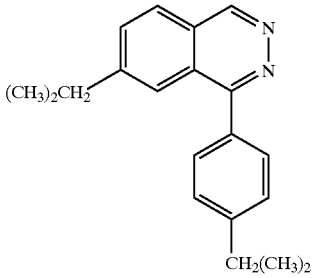
(III-75)
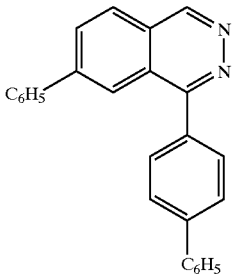
(III-76)
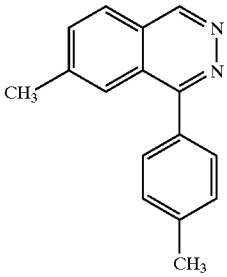
(III-77)
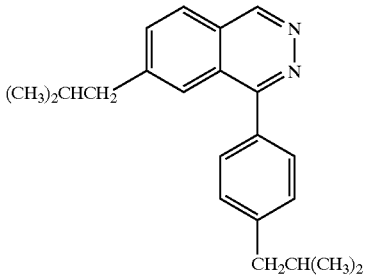

-continued (III-78)

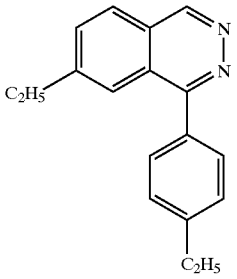

(III-79)

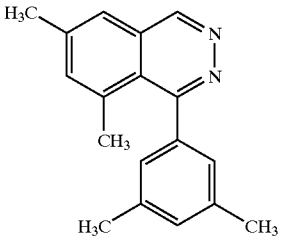

(III-80)

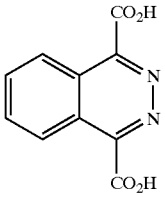

(III-81)

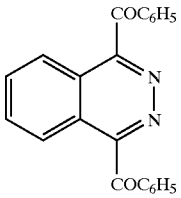

(III-82)

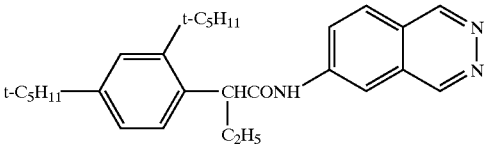

(III-83)

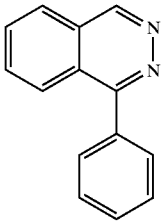

(III-84)

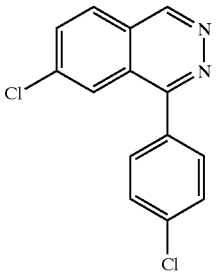

-continued (III-85)

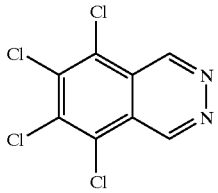

The amount of the phthalazine compound represented by the formula (3) is preferably $10^{-4}$ mole to 1 mole/mole Ag, more preferably $10^{-3}$ mole to 0.3 mole/mole Ag, further preferably $10^{-3}$ mole to 0.1 mole/mole Ag, in terms of molar amount per mole of Ag.

The phthalazine compound represented by the formula (3) may be added in any form, for example, as a solution, powder, solid microparticle dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The phthalazine compound represented by the formula (3) may be added to any layer on a support provided on the same side as the aforementioned photosensitive silver halide and the reducible silver salt, and it is preferably added to a layer containing the silver halide or a layer adjacent thereto.

The silver salt of an organic acid that can be used for the present invention is a silver salt which is relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chained aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percent of silver behenate with respect to silver salt of an organic acid to be used. As silver salts of an organic acid other than silver behenate contained in the silver salts of organic acid used for the present invention, the silver salts of an organic acid exemplified above can preferably be used.

Silver salts of an organic acid that can be preferably used for the present invention can be prepared by allowing a solution or suspension of an alkali metal salt (e.g., Na salts, K salts, Li salts) of the aforementioned organic acids to react with silver nitrate. As the preparation method, the method described in Japanese Patent Application No. 11-104187, paragraphs 0019–0021 can be used.

In the present invention, a method of preparing a silver salt of an organic acid by adding an aqueous solution of silver nitrate and a solution of alkali metal salt of an organic acid into a sealable means for mixing liquids can preferably be used. Specifically, the method described in Japanese Patent Application No. 11-203413 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in Japanese Patent Application No. 11-115457, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited thereto.

The tertiary alcohol used for the present invention may be added in any timing during the preparation of the organic acid silver salt, but the tertiary alcohol is preferably used by adding it at the time of preparation of the organic acid alkali metal salt to dissolve the organic alkali metal salt. The tertiary alcohol for use in the present invention may be added in any amount of from 0.01 to 10 in terms of the weight ratio to water used as a solvent for the preparation of the silver salt of an organic acid, but preferably added in an amount of from 0.03 to 1 in terms of weight ratio to water.

Although shape and size of the organic acid silver salt for use in the present invention are not particularly limited, those mentioned in Japanese Patent Application No. 11-104187, paragraph 0024 can be preferably used. The shape of the organic acid silver salt can be determined from a transmission electron microscope image of organic silver salt dispersion. An example of the method for determining monodispesibility is a method comprising obtaining the standard deviation of a volume weight average diameter of the organic acid silver salt. The percentage of a value obtained by dividing the standard deviation by the volume weight average diameter (variation coefficient) is preferably 80% or less, more preferably 50% or less, particularly preferably 30% or less. As a measurement method, for example, the grain size can be determined by irradiating organic acid silver salt dispersed in a liquid with a laser ray and determining an autocorrelation function for change of the fluctuation of the scattered light with time (volume weight average diameter). The average grain size determined by this method is preferably from 0.05 to 10.0 $\mu$m, more preferably from 0.1 to 5.0 $\mu$m, further preferably from 0.1 to 2.0 $\mu$m, as in solid microparticle dispersion.

The silver salt of an organic acid which can be used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method described in Japanese Patent Application No. 11-115457 can be used.

For obtaining an organic acid silver salt solid dispersion having a high S/N ratio and a small grain size and being free from coagulation, there is preferably used in the present invention a dispersion method comprising steps of converting an aqueous dispersion that contains a silver salt of an organic acid as an image-forming medium and contains substantially no photosensitive silver salt into a high-speed flow dispersion, and then releasing the pressure. As such a dispersion method, the method mentioned in Japanese Patent Application No. 11-104187, paragraphs 0027–0038 can be used.

The grain size distribution of the grain solid dispersion of silver salt of an organic acid for use in the present invention is preferably monodispersion. Specifically, the percentage (variation coefficient) of the value obtained by dividing the standard deviation of the volume weight average diameter by the volume weight average diameter is preferably 80% or less, more preferably 50% or less, particularly preferably 30% or less.

The organic acid silver salt grain solid dispersion used for the present invention comprises at least a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount, and it is preferably used in an amount of from 0.1 to 5 g/m$^2$, more preferably from 1 to 3 g/m$^2$, in terms of silver.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt, not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, but not halide compounds.

The metal ions selected from Ca, Mg, Zn and Ag, which are preferably used in the present invention, may be added at any time after the formation of non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The photosensitive silver halide used for the present invention is not particularly limited as for the halogen composition, and silver chloride, silver chlorobromide, silver bromide, silver iodobromide, silver chloroiodobromide and so forth may be used. As for the preparation of grains of the photosensitive silver halide emulsion, the grains can be prepared by the method described in JP-A-11-119374, paragraphs 0217–0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halide composition may have a uniform distribution in the inner part and the surface of the grains, or the composition may change stepwise or continuously in the grains. Silver halide grains having a core/shell structure may also be preferably used. Core/shell grains having preferably a double to quintuple structure, more preferably a double to quadruple structure may be used. A technique for localizing silver bromide on the surface of silver chloride or silver chlorobromide grains may also be preferably used.

As for the grain size distribution of the silver halide grains used for the present invention, the grains show monodispersion degree of 30% or less, preferably 1–20%, more preferably 5–15%. The monodispersion degree used herein is defined as a percentage (%) of a value obtained by dividing standard deviation of grain size by average grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains used for the present invention preferably contain a metal of Group VII or Group VIII in the periodic table of elements or a complex of such a metal. The metal of Group VII or Group VIII of the periodic table or the center metal of the complex is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more complexes of the same or different metals may also be used in combination. The metal or metal complex content is preferably from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures described in JP-A-7-225449 and so forth can be used. Types and addition methods of these heavy metals and complexes thereof are described in JP-A-11-119374, paragraphs 0227–0240.

The photosensitive silver halide emulsions may be desalted by washing methods with water known in the art, such as the noodle washing and flocculation washing. However, the grains may not be desalted in the present invention.

The photosensitive silver halide grains are preferably subjected to chemical sensitization. For the chemical sensitization, the method described in JP-A-11-119374, paragraphs 0242–0250 can preferably be used.

Silver halide emulsions used in the present invention may be added with thiosulfonic acid compounds by the method described in EP-A-293,917.

As gelatin used with the photosensitive silver halide used for the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000 ) during the grain formation and use lowmolecular weight gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, acid-treated gelatin, modified gelatin such as phthalated gelatin and so forth can also be used.

In the photosensitive material used for the present invention, one kind of photosensitive silver halide emulsion may be used or two or more different emulsions (for example, those having different average grain sizes, different halogen compositions, different crystal habits or those subjected to chemical sensitization under different conditions) may be used in combination.

The amount of the photosensitive silver halide is preferably from 0.01–0.5 mole, more preferably from 0.02–0.3 mole, still more preferably from 0.03–0.25 mole per mole of the silver salt of an organic acid. Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibrating mill, homogenizer or the like, or a method of preparing a silver salt of an organic acid by mixing a photosensitive silver halide obtained separately at any time during the preparation of the silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. For example, as dyes that spectrally sensitize in a wavelength range of 550 nm to 750 nm, there can be mentioned the compounds of formula (II) described in JP-A-10-186572, and more specifically, dyes of II-6, II-7, II-14, II-15, II-18, II-23 and II-25 mentioned in the same can be exemplified as preferred dyes. As dyes that spectrally sensitize in a wavelength range of 750 nm to 1400 nm, there can be mentioned the compounds of formula (I) described in JP-A-11-119374, and more specifically, dyes of (25), (26), (30), (32), (36), (37), (41), (49) and (54) mentioned in the same can be exemplified as preferred dyes. Further, as dyes forming J-band, those disclosed in U.S. Pat. Nos. 5,510,236, 3,871,887 (Example 5), JP-A-2-96131 and JP-A-59-48753 can be exemplified as preferred dyes. These sensitizing dyes can be used each alone, or two or more of them can be used in combination.

These sensitizing dyes can be added by the method described in JP-A-11-119374, paragraph 0106. However, the method is not particularly limited to this method.

While the amount of the sensitizing dye used in the present invention may be selected to be a desired amount depending on the performance including sensitivity and fog, it is preferably used in an amount of $10^{-6}$–1 mole, more preferably $10^{-4}$–$10^{-1}$ mole, per mole of silver halide in the photosensitive layer.

In the present invention, a supersensitizer can be used in order to improve spectral sensitization efficiency. Examples of the supersensitizer used for the present invention include the compounds disclosed in EP-A-587,338, U.S. Pat. Nos. 3,877,943 and 4,873,184, and compounds selected from heteroaromatic or aliphatic mercapto compounds, heteroaromatic disulfide compounds, stilbenes, hydrazines and triazines, and so forth.

Particularly preferred supersensitizers are heteroaromatic mercapto compounds and heteroaromatic disulfide compounds disclosed in JP-A-5-341432, the compounds represented by the formulas (I) and (II) mentioned in JP-A-4-182639, stilbene compounds represented by the formula (I) mentioned in JP-A-10-111543 and the compounds represented by the formula (I) mentioned in JP-A-11-109547. Specifically, there can be mentioned the compounds of M-1 to M-24 mentioned in JP-A-5-341432, the compounds of d-1) to d-14) mentioned in JP-A-4-182639, the compounds of SS-01 to SS-07 mentioned in JP-A-10-111543 and the compounds of 31, 32, 37, 38, 41–45 and 51–53 mentioned in JP-A-11-109547.

These supersensitizers can be added to the emulsion layer preferably in an amount of $10^{-4}$–1 mole, more preferably in an amount of 0.001–0.3 mole, per mole of silver halide.

The photothermographic material of the present invention preferably contains an ultrahigh contrast agent.

While type of the ultrahigh contrast agent that can be used for the present invention is not particularly limited, preferred examples thereof include all of the hydrazine derivatives represented by the formula (H) mentioned in Japanese Patent Application No. 11-87297 (specifically, the hydrazine derivatives mentioned in Tables 1–4 of the same), the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP-A-741,320.

Particularly preferably used ultrahigh contrast agents are the substituted alkene derivatives, substituted isoxazole derivatives and particular acetal compounds represented by the formulas (1) to (3) mentioned in Japanese Patent Application No. 11-87297, and more preferably, the cyclic compounds represented by the formula (A) or (B) mentioned in the same, specifically Compounds 1–72 mentioned in Chem. 8 to Chem. 12 of the same, may be used. Two or more of these ultrahigh contrast agents may be used in combination.

The ultrahigh contrast agent may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the ultrahigh contrast agent may be used by dispersing powder of the ultrahigh contrast agent in a suitable solvent such as water using a ball mill, colloid mill, or by means of ultrasonic wave according to a known method for solid dispersion.

While the ultrahigh contrast agent may be added to any layer on the image-forming layer side of a support, it is preferably added to the image-forming layer or a layer adjacent thereto.

The amount of the ultrahigh contrast agent is $1\times10^{-6}$ mole to 1 mole, more preferably from $1\times10^{-5}$ mole to $5\times10^{-1}$ mole, further preferably from $2\times10^{-5}$ mole to $2\times10^{-1}$ mole, per mole of silver.

In addition to the aforementioned compounds, the compounds disclosed in U.S. Pat. Nos. 5,545,515, 5,635,339, 5,654,130 International Patent Publication W097/34196 and U.S. Pat. No. 5,686,228, and the compounds disclosed in JP-A-11-119372, JP-A-11-133546, Japanese Patent Application No. 9-309813, JP-A-11-119373, Japanese Patent Application No. 9-282564, JP-A-11-95365, JP-A-11-95366 and Japanese Patent Application No. 9-332388 may also be used.

In the present invention, a contrast accelerator may be used in combination with the above-described ultrahigh contrast agent for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14, and so forth may be used.

Formic acid and formic acid salts serve as a strongly fogging substance in a photothermographic material containing a non-photosensitive silver salt, a photosensitive silver halide and a binder. In the present invention, the photothermographic material preferably contains formic acid or a formic acid salt on the side having the image-forming layer containing a photosensitive silver halide in an amount of 5 mmol or less, more preferably 1 mmol or less, per 1 mole of silver.

In the photothermographic material of the present invention, an acid formed by hydration of diphosphorus pentoxide or a salt thereof is preferably used together with the ultrahigh contrast agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$of the photosensitive material) depending on the desired performance including sensitivity and fog. However, it can preferably be used in an amount of 0.1–500 $mg/^2$,more preferably 0.5–100 $mg/m^2$.

The photothermographic material of the present invention preferably has a film surface pH of 6.0 or less, more preferably 5.5 or less before heat development. While it is not particularly limited as for the lower limit, it is normally around 3 or higher.

For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

The silver halide emulsion and/or the silver salt of an organic acid for use in the photothermographic material of the present invention can be further prevented from the production of additional fog or stabilized against the reduction in sensitivity during the stock storage, by an antifoggant, a stabilizer or a stabilizer precursor. Examples of suitable antifoggant, stabilizer and stabilizer precursor that can be used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Pat. No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The photothermographic material of the present invention may contain a benzoic acid compound for the purpose of achieving high sensitivity or preventing fog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637. The benzoic acid compound may be added to any layer of the photothermographic material, but the layer to which the benzoic acid is added is preferably a layer on the side having the image-forming layer, more preferably a layer containing a silver salt of an organic acid. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound may be added in any form such as powder, solution, and microparticle dispersion, or it may be added as a solution containing a mixture of the benzoic acid compound with other additives such as a sensitizing dye, reducing agent and color tone adjuster. The benzoic acid compound may be added in any amount, preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The hydrophilic organic halides represented by the formula (P) mentioned in Japanese Patent Application No. 11-87297 can be preferably used as the antifoggant. Specifically, the compounds (P-1) to (P-118) mentioned in the same are preferably used.

The amount of the organic halide is preferably $1\times10^{-5}$ mole to 2 mole/mole Ag, more preferably $5\times10^{-5}$ mole to 1 mole/mole Ag, further preferably $1\times10^{-4}$ mole to $5\times10^{-1}$ mole/mole Ag, in terms of molar amount per mole of Ag (mole/mole Ag). The organic halides may be used each alone, or two or more of them may be used in combination.

Further, the salicylic acid derivatives represented by the formula (Z) mentioned in Japanese Patent Application No. 11-87297 can be preferably used as the antifoggant. Specifically, the compounds (A-1) to (A-60) mentioned in the same are preferably used. The amount of the salicylic acid represented by the formula (Z) is preferably $1\times10^{-5}$ mole to $5\times10^{-1}$ mole/mole Ag, more preferably $5\times10^{-5}$ mole to $1\times10^{-1}$ mole/mole Ag, further preferably $1\times10^{-4}$ mole to $5\times10^{-2}$ mole/mole Ag, in terms of molar amount per mole of Ag (mole/mole Ag). The salicylic acid derivatives may be used each alone, or two or more of them may be used in combination.

As antifoggants preferably used in the present invention, formalin scavengers are effective. Examples thereof include the compounds represented by the formula (S) and the exemplary compounds thereof (S-1) to (S-24) mentioned in Japanese Patent Application No. 11-23995.

The antifoggant used for the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, it may be used by dispersing powder of them in water using a ball mill, colloid mill, sand grinder mill, MANTON GAULIN, microfluidizer, or by means of ultrasonic wave according to a known method for solid dispersion.

While the antifoggant used in the present invention may be added to any layer on the image-forming layer side of a support, that is, the image-forming layer or another layer on that side, they are preferably added to the image-forming layer ora layer adjacent thereto. The image-forming layer is a layer containing a reducible silver salt (silver salt of an organic acid). Preferably such an image-forming layer further contains a photosensitive silver halide.

The photothermographic material of the present invention may contain a mercapto compound, disulfide compound or thione compound so as to control the development by inhibiting or accelerating the development or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of a halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole and so forth. However, the present invention is not limited to these.

The amount of the mercapto compound is preferably from 0.0001 to 1.0 mole, more preferably from 0.001 to 0.3 mole, per mole of silver in the image-forming layer.

The photothermographic material of the present invention has an image-forming layer containing a silver salt of an organic acid, a reducing agent and a photosensitive silver halide on a support, and at least one protective layer is preferably provided on the image-forming layer. Further, the photothermographic material of the present invention preferably has at least one back layer on the side of the support opposite to the side of the image-forming layer (back side), and polymer latex is used as binder of the image-forming layer, protective layer and back layer. The use of polymer latex for these layers enables coating with an aqueous system utilizing a solvent (dispersion medium) containing water as a main component. Not only this is advantageous for environment and cost, but also it makes it possible to provide photothermographic materials which generate no wrinkle upon heat development. Further, by using a support subjected to a predetermined heat treatment, there are provided photothermographic materials exhibiting little dimensional change in sizes before and after the heat development.

As the binder used for the present invention, the polymer latex explained below is preferably used.

Among image-forming layers containing a photosensitive silver halide in the photothermographic material of the present invention, at least one layer is preferably an image-forming layer utilizing polymer latex to be explained below in an amount of 50 weight % or more with respect to the total amount of binder. The polymer latex may be used not only in the image-forming layer, but also in the protective layer, back layer or the like. When the photothermographic material of the present invention is used for, in particular, printing use in which dimensional change causes problems, the polymer latex is preferably used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules having a hydrophilic portion are dispersed in a molecular state or the like. Polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have an average particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be latex of the so-called core/shell type, which is different from ordinary polymer latex of a uniform structure. In this case, use of different glass transition temperatures of the core and shell may be preferred.

Preferred range of the glass transition temperature (Tg) of the polymer latex preferably used as the binder in the present invention varies for the protective layer, back layer and image-forming layer. As for the image-forming layer, the glass transition temperature is preferably −30 to 40° C. for accelerating diffusion of photographic elements during the heat development. Polymer latex used for the protective layer or back layer preferably has a glass transition temperature of 25 to 70° C., because these layers are brought into contact with various apparatuses.

The polymer latex used in the present invention preferably shows a minimum film forming temperature (MFT) of about −30–90° C., more preferably about 0–70° C. A film-forming aid may be added in order to control the minimum film forming temperature. The film-forming aid is also referred to as a plasticizer, and consists of an organic compound (usually an organic solvent) which lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably suffer from insufficient mechanical strength of the image-forming layer, and those having a too large molecular weight may unfavorably suffer from bad film forming property.

Examples of the polymer latex used as the binder of the image-forming layer of the photothermographic material of the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available and examples thereof include acrylic resins such as CEBIAN A-4635, 46583, 4601 (all produced by Dicel Kagaku Kogyo Co., Ltd), Nipol Lx811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX410, 430, 435, 438C (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or if desired, as a blend of two or more of them.

The image-forming layer preferably contains 50 weight % or more, more preferably 70 weight % or more of the aforementioned polymer latex based on the total binder.

If desired, the image-forming layer may contain a hydrophilic polymer in an amount of 50 weight % or less of the total binder, such as gelatin, polyvinyl alcohol, methylcellulose, hydroxypropylcellulose, carboxymethylcellulose and hydroxypropylmethylcellulose. The amount of the hydrophilic polymer is preferably 30 weight % or less, more preferably 15 weight % or less, of the total binder in the image-forming layer.

The image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The total amount of the binder in the image-forming layer is preferably from 0.2 to 30 g/m$^2$, more preferably from 1 to 15 g/m$^2$. The image-forming layer may contain a crosslinking agent for crosslinking, surfactant for improving coatability and so forth.

Further, a combination of polymer latexes having different I/O values is also preferably used as the binder of the protective layer. The I/O values are obtained by dividing an inorganicity value with an organicity value, both of which values are based on the organic conceptual diagram described in Japanese Patent Application No. 11-6872, paragraphs 0025–0029.

In the present invention, a plasticizer (e.g., benzyl alcohol, 2,2,4-trimethylpentanediol-1,3-monoisobutyrate etc.) described in Japanese Patent Application No. 11-143058, paragraphs 0021–0025 can be added to control the film-forming temperature. Further, a hydrophilic polymer may be added to a polymer binder, and a water-miscible organic solvent may be added to a coating solution as described in Japanese Patent Application No. 11-6872, paragraphs 0027–0028.

First polymer latex having a functional group, and a crosslinking agent and/or second polymer latex having a functional group that can react with the first polymer latex, which are described in Japanese Patent Application No. 10-199626, paragraphs 0023–0041, can also be added to each layer.

The aforementioned functional groups may be carboxyl group, hydroxyl group, isocyanate group, epoxy group, N-methylol group, oxazolinyl group or the like. The crosslinking agent is selected from epoxy compounds, isocyanate compounds, blocked isocyanate compounds, methylolated compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40-80D, WX-1741 (Asahi Chemical Industry Co., Ltd.), Bayhydur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), water dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

The total amount of the binders for the image-forming layer is preferably in the range of 0.2–30 g/m$^2$, more preferably 1.0–15 g/m$^2$.

The total amount of the binders for the protective layer is preferably in the range of 0.2–10.0 g/m$^2$, more preferably 0.5–6.0 g/m$^2$.

The total amount of the binders for the back layer is preferably in the range of 0.01–10.0 g/m$^2$, more preferably 0.05–5.0 g/m$^2$.

Each of these layers may be provided as two or more layers. When the image-forming layer consists of two or more layers, it is preferred that polymer latex is used as a binder for all of the layers. The protective layer is a layer provided on the image-forming layer, and it may consist of two or more layers. In such a case, it is preferred that polymer latex should be used for at least one layer, especially the outermost protective layer. Further, the back layer is a layer provided on an undercoat layer for the back side of the support, and it may consist of two or more layers. In such a case, it is preferred that polymer latex is used for at least one layer, especially the outermost back layer.

A lubricant referred to in the present specification means a compound which, when present at the surface of an object, reduces the friction coefficient of the surface compared with that observed when the compound is absent. The type of the lubricant is not particularly limited.

Examples of the lubricant which can be used in the present invention include the compounds described in JP-A-11-84573, paragraphs 0061–0064 and Japanese Patent Application No. 11-106881, paragraphs 0049–0062.

Preferred examples of the lubricant include Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.), W-1: $C_{16}H_{33}$—O—$SO_3Na$ W-2: $C_{18}H_{37}$—O—$SO_3Na$ and so forth.

The amount of the lubricant used is 0.1 to 50 weight %, preferably 0.5 to 30 weight %, of the amount of binder in a layer to which the lubricant is added.

When such a development apparatus as disclosed in Japanese Patent Application Nos. 10-346561 and 11-106881 is used, in which a photothermographic material is transported in a pre-heating section by facing rollers, and the material is transported in a heat development section by driving force of rollers facing the image-forming layer side of the material, while the opposite back surface slides on a smooth surface, ratio of friction coefficients of the outermost surface of the image-forming layer side of the material and the outermost surface of the back layer is 1.5 or more at the heat development temperature. Although the ratio is not particularly limited for its upper limit, it is about 30 or less. The value of $\mu b$ included in the following equation is 1.0 or less, preferably 0.05–0.8. The ratio can be obtained in accordance with the following equation.

Ratio of friction coefficients=coefficient of dynamic friction between roller material of heat development apparatus and surface of image-forming layer side ($\mu e$)/coefficient of dynamic friction between material of smooth surface member of heat development apparatus and back surface ($\mu b$)

In the present invention, the lubricity between the materials of the heat development apparatus and the surface of image-forming layer side and/or the opposite back surface at the heat development temperature can be controlled by adding a lubricant to the outermost layers and adjusting its addition amount.

It is preferred to provide, on both surfaces, an undercoat layer containing a vinylidene chloride copolymer comprising 70 weight % or more of repetition units of vinylidene chloride monomers. Such a vinylidene chloride copolymer is disclosed in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Pat. No. 2,557,641, page 2, right column, line 20 to page 3, right column, line 30, Japanese Patent Application No. 10-221039, paragraphs 0020–0037 and Japanese Patent Application No. 11-106881, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers, in addition to the repetition units of vinylidene chloride monomer. A polymer consisting solely of vinylidene chloride monomers tends to crystallize, and therefore it becomes difficult to form a uniform film when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded.

The content of the vinylidene chloride copolymer used in the present invention is such an amount that the undercoat layers should have a thickness of 0.3 $\mu$m or more, preferably 0.3 $\mu$m to 4 $\mu$m, as a total thickness of the undercoat layers containing the vinylidene chloride copolymer for one side.

The vinylidene chloride copolymer layer as an undercoat layer is preferably provided as a first undercoat layer, which is directly coated on the support, and usually one vinylidene chloride copolymer layer is provided for each side. However, two or more of layers may be provided as the case may be. When multiple layers consisting of two or more layers are provided, the total amount of the vinylidene chloride copolymer may be within the range of the present invention defined above.

Such an undercoat layer may contain a crosslinking agent, matting agent or the like, in addition to the vinylidene chloride copolymer.

The support may be coated with an undercoat layer comprising SBR, polyester, gelatin or the like as a binder, in addition to the vinylidene chloride copolymer layer, as required. These undercoat layers may have a multilayer structure, and may be provided on one side or both sides of the support. The undercoat layers generally have a thickness (per layer) of 0.01–5 $\mu$m, more preferably 0.05–1 $\mu$m.

For the photothermographic material of the present invention, various kinds of supports can be used. Typical supports comprise polyester such as polyethylene terephthalate, and polyethylene naphthalate, cellulose nitrate, cellulose ester, polyvinylacetal, syndiotactic polystyrene, polycarbonate, paper support of which both surfaces are coated with polyethylene or the like. Among these, biaxially stretched polyester, especially polyethylene terephthalate (PET), is preferred in view of strength, dimensional stability, chemical resistance and so forth. The support preferably has a thickness of 90–180 $\mu$m as a base thickness which does not contain the undercoat layers.

Preferably used as the support of the photothermographic material of the present invention is a polyester, in particular, polyethylene terephthalate, subjected to a heat treatment in a temperature range of 130–185° C. in order to relax the internal distortion formed in the film during the biaxial stretching so that thermal shrinkage distortion occurring during the heat development should be eliminated. Such films are described in JP-A-10-48772, JP-A-10-10676, JP-A-10-10677, JP-A-11-65025 and Japanese Patent Application No. 9-308898.

After such a heat treatment, the support preferably shows dimensional changes caused by heating at 120° C. for 30 seconds of −0.03% to +0.01% for the machine direction (MD) and 0 to 0.04% for the transverse direction (TD).

The photothermographic material of the present invention can be subjected to an antistatic treatment using the conductive metal oxides and/or fluorinated surfactants disclosed in JP-A-11-84573, paragraphs 0040–0051 for the purposes of reducing adhesion of dusts, preventing generation of static marks, preventing transportation failure during the automatic transportation process and so forth. As the conductive metal oxides, the conductive acicular tin oxide doped with antimony disclosed in U.S. Pat. No. 5,575,957 and Japanese Patent Application No. 10-41302, paragraphs 0012–0020 and the fibrous tin oxide doped with antimony disclosed in JP-A-4-29134 can be preferably used.

The layer containing a metal oxide should show a surface specific resistance (surface resistivity) of $10^{12}$ Ω or less, preferably $10^{11}$ Ω or less, in an atmosphere at 25° C. and 20% of relative humidity. Such a resistivity provides good antistatic property. Although the surface resistivity is not particularly limited as for the lower limit, it is usually about $10^{7}$ Ω.

The photothermographic material of the present invention preferably has a Beck's smoothness of 2000 seconds or less, more preferably 10 seconds to 2000 seconds, as for at least one of the outermost surfaces of the image-forming layer side and the opposite side, preferably as for the both sides.

Beck smoothness can be easily determined according to Japanese Industrial Standard (JIS) P8119, "Test Method for Smoothness of Paper and Paperboard by Beck Test Device" and TAPPI Standard Method T479.

Beck smoothness of the outermost surfaces of the image-forming layer side and the opposite side of the photothermographic material can be controlled by suitably selecting particle size and amount of matting agent to be contained in the layers constituting the surfaces as described in JP-A-11-84573, paragraphs 0052–0059.

In the present invention, water-soluble polymers are preferably used as a thickener for imparting coating property. The polymers may be either naturally occurring polymers or synthetic polymers, and types thereof are not particularly limited. Specifically, there are mentioned naturally occurring polymers such as starches (corn starch, starch etc.), seaweeds (agar, sodium arginate etc.), vegetable adhesive substances (gum arabic etc.), animal proteins (glue, casein, gelatin, egg white etc.) and adhesive fermentation products (pullulan, dextrin etc.), semi-synthetic polymers such as semi-synthetic starches (soluble starch, carboxyl starch, dextran etc.) and semi-synthetic celluloses (viscose, methylcellulose, ethylcellulose, carboxymethylcellulose, hydroxyethylcellulose, hydroxypropylcellulose, hydroxypropylmethylcellulose etc.), synthetic polymers (polyvinyl alcohol, polyacrylamide, polyvinylpyrrolidone, polyethylene glycol, polypropylene glycol, polyvinyl ether, polyethylene-imine, polystyrenesulfonic acid or styrenesulfonic acid copolymer, polyvinylslfanoic acid or vinylslfanoic acid copolymer, polyacrylic acid or acrylic acid copolymer, acrylic acid or acrylic acid copolymer, maleic acid copolymer, maleic acid monoester copolymer, polyacryloyl methylpropanesulfonate or acryloyl methylpropanesulfonate copolymer) and so forth.

Among these, water-soluble polymers preferably used are sodium arginate, gelatin, dextran, dextrin, methylcellulose, carboxymethylcellulose, hydroxyethylcellulose, hydroxypropylcellulose, polyvinyl alcohol, polyacrylamide, polyvinylpyrrolidone, polyethylene glycol, polypropylene glycol, polystyrenesulfonic acid or styrenesulfonic acid copolymer, polyacrylic acid or acrylic acid copolymer, maleic acid monoester copolymer, polyacryloylmethyl propanesulfonate or acryloylmethyl propanesulfonate copolymer, and they are particularly preferably used as a thickener.

Among these, particularly preferred thickeners are gelatin, dextran, methylcellulose, carboxymethylcellulose, hydroxyethylcellulose, polyvinyl alcohol, polyacrylamide, polyvinylpyrrolidone, polystyrenesulfonate or styrenesulfonate copolymer, polyacrylic acid or acrylic acid copolymer, maleic acid monoester copolymer and so forth. These compounds are described in detail in "Shin Suiyosei Polymer no Oyo to Shijo (Applications and Market of Water-soluble Polymers, New Edition)", CMC Shuppan, Inc., Ed. by Shinji Nagatomo, Nov. 4, 1988.

The amount of the water-soluble polymer used as a thickener is not particularly limited so long as viscosity is increased when it is added to a coating solution. Its concentration in the solution is generally 0.01 to 30 weight %, preferably 0.05 to 20 weight %, particularly preferably 0.1 to 10 weight %. Viscosity to be increased by the polymers is preferably 1–200 cp, more preferably 5–100 cp, as increased degree of viscosity compared with the initial viscosity. The viscosity is represented with values measured at 25° C. by using B type rotational viscometer. Upon addition to a coating solution or the like, it is generally desirable that the thickener is added as a solution diluted as far as possible. It is also desirable to perform the addition with sufficient stirring.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting the surfactants described be low and using them. As the surfactants used in the present invention, any of nonionic or ionic (anionic, cationic, betaine) surfactants can be used. Further, fluorinated surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphate salts. Typical examples thereof are aliphatic acid salts, alkylbenzenesulfonates, alkylnaphthalenesulfonates, alkylsulfonates, α-olefinsulfonates, dialkylsulfosuccinates, α-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary amine salts and quaternary ammonium salts (tetraalkylammonium salts, trialkylbenzylammonium salts, alkylpyridinium salts, alkylimidazolium salts etc.) can be mentioned.

Examples of betaine type surfactants include carboxybetaine, sulfobetaine and so forth, and N-trialkyl-N-carboxymethylammonium betaine, N-trialkyl-N-sulfoalkyleneammonium betaine and so forth can be mentioned.

These surfactants are described in Takao Kariyone, "Kaimen Kasseizai no yo (Applications of Surfactants", Saiwai Shobo, Sep. 1, 1980). In the present invention, amounts of the preferred surfactants are not particularly limited, and they can be used in an amount providing desired surface activating property. The coating amount of the fluorine-containing surfactants is preferably 0.01–250 mg per 1 $m^2$.

Specific examples of the surfactants are mentioned below. However, the surfactants are not limited to these (—$C_6H_4$— represents phenylene group in the following formulas).

WA-1: $C_{16}H_{33}(OCH_2CH_2)_{10}OH$

WA-2: $C_gH_{19}$—$C_6H_4$—$(OCH_2CH_2)_{12}OH$

WA-3: Sodium dodecylbenzenesulfonate

WA-4: Sodium tri(isopropyl)naphthalenesulfonate

WA-5: Sodium tri(isobutyl)naphthalenesulfonate

WA-6: Sodium dodecylsulfate

WA-7: α-Sulfasuccinic acid di(2-ethylhexyl) ester sodium salt

WA-8: $C_8H_{17}$—$C_6H_4$—$(CH_2CH_2O)_3(CH_2)_2SO_3K$

WA-10: Cetyltrimethylammonium chloride

WA-11: $C_{11}H_{23}CONHCH_2CH_2N^{(+)}(CH_3)_2$—$CH_2COO^{(-)}$

WA-12: $C_8F_{17}SO_2N(C_3H_7)(CH_2CH_2O)_{16}H$

WA-13: $C_8F_{17}SO_2N(C_3H_7)CH_2COOK$

WA-14: $C_8F_{17}SO_3K$

WA-15: $C_8F_{17}SO_2N(C_3H_7)(CH_2CH_2O)_4(CH_2)_4SO_3Na$

WA-16: $C_8F_{17}SO_2N(C_3H_7)(CH_2)_3OCH_2CH_2N^{(+)}(CH_3)_3$—$CH_3$●$C_6H_4$—$SO_3^{(-)}$

WA-17: $C_8F_{17}SO_2N(C_3H_7)CH_2CH_2CH_2N^{(+)}(CH_3)_2$—$CH_2COO^{(-)}$

In a preferred embodiment of the present invention, an intermediate layer may be provided as required in addition to the image-forming layer and the protective layer. To improve the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in Japanese Patent Application No. 10-292849, FIG. 1, is particularly preferred.

Silver halide photographic photosensitive materials utilizing gelatin as a main binder are rapidly cooled in a first drying zone, which is provided downstream from a coating dye. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As drying method after the second drying zone, there can be mentioned the air loop method where a support supported by rollers is blown by air jet from a U-shaped duct, the helix method (air floating method) where the support is helically wound around a cylindrical duct and dried during transportation and so forth.

When the layers are formed by using coating solutions comprising polymer latex as a main component of binder, the flow of the coating solution cannot be stopped by rapid cooling. Therefore, the predrying may be insufficient only with the first drying zone. In such a case, if such a drying method as utilized for silver halide photographic photosensitive materials is used, uneven flow or uneven drying may occur, and therefore serious defects are likely to occur on the coated surface.

The preferred drying method for the present invention is such a method as described in Japanese Patent Application No. 10-292849, where the drying is attained in a horizontal drying zone irrespective of the drying zones, i.e., the first or second drying zone, at least until the constant rate drying is finished. The transportation of the support during the period immediately after the coating and before the support is introduced into the horizontal drying zone may be performed either horizontally or not horizontally, and the rising angle of the material with respect to the horizontal direction of the coating machine may be within the range of 0–70°. Further, in the horizontal drying zone used in the present invention, the support may be transported at an angle within ±15° with respect to the horizontal direction of the coating machine, and it does not mean exactly horizontal transportation.

The constant rate drying used in the present invention means a drying process in which all entering calorie is consumed for evaporation of solvent at a constant liquid film temperature. Decreasing rate drying means a drying process where the drying rate is reduced by various factors (for example, diffusion of moisture in the material for transfer becomes a rate-limiting factor, evaporation surface is recessed etc.) in an end period of the drying, and imparted calorie is also used for increase of liquid film temperature. The critical moisture content for the transition from the constant rate drying to the decreasing rate drying is 200–300%. When the constant rate drying is finished, the drying has sufficiently progressed so that the flowing should be stopped, and therefore such a drying method as used for silver halide photographic photosensitive materials may also be employable. In the present invention, however, it is preferred that the drying should be performed in a horizontal drying zone until the final drying degree is attained even after the constant rate drying.

As for the drying condition for forming the image-forming layer and/or protective layer, it is preferred that the liquid film surface temperature during the constant rate drying should be higher than minimum film forming temperature (MTF) of polymer latex (MTF is usually higher than glass transition temperature Tg of polymer by 3–5° C.). In many cases, it is usually selected from the range of 25–40° C., because of limitations imposed by production facilities. Further, the dry bulb temperature during the decreasing rate drying is preferably lower than Tg of the support (in the case of PET, usually 80° C. or lower). The liquid film surface temperature referred to in this specification means a solvent liquid film surface temperature of coated liquid film coated on a support, and the dry bulb temperature means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface. Further, film strength also becomes weak and thus it becomes likely that there arise serious problems, for example, the film becomes liable to suffer from scratches during transportation in a light exposure apparatus or heat development apparatus.

On the other hand, if the drying is performed under a condition that elevates the liquid film surface temperature, the protective layer mainly consisting of polymer latex rapidly becomes a film, but the under layers including the image-forming layer do not lose flowability, and hence it is likely that unevenness is formed on the surface. Furthermore, if the support (base) is subjected to a temperature higher than its Tg, dimensional stability and resistance to curl tendency tends to be degraded.

While the same is applied to the serial coating, in which an under layer is coated and dried, and then an upper layer is coated. As for properties of coating solutions, when an upper layer and a lower layer are coated as stacked layers by coating the upper layer before drying of the lower layer, in particular, a coating solution for the image-forming layer and a coating solution for protective layer preferably show a pH difference of 2.5 or less, and a smaller value of this pH difference is more preferred. If the pH difference between the coating solutions becomes large, it becomes likely that microscopic aggregations are generated at the interface of the coating solutions and thus it becomes likely that serious defects of surface condition such as coating stripes occur during continuous coating for a long length.

The coating solution for the image-forming layer preferably has a viscosity of 15–100 cp, more preferably 30–70 cp, at 25° C. The coating solution for the protective layer preferably has a viscosity of 5–75 cp, more preferably 20–50 cp, at 25° C. These viscosities are measured by using a B-type viscometer.

The rolling up after the drying is preferably carried out under conditions of a temperature of 20–30° C. and a relative humidity of 45±20%. As for rolled shape, the material may be rolled so that the surface of the image-forming layer side, may be toward the outside or inside of the roll according to a shape suitable for subsequent processing. Further, it is also preferred that, when the material is further processed in a rolled shape, the material is rolled up into a shape of roll in which the sides are reversed compared with the original rolled shape during processing, in order to eliminate the curl generated while the material is in the original rolled shape. Relative humidity of the photosensitive material is preferably controlled to be in the range of 20–55% (measured at 25° C.).

In conventional coating solutions of photographic emulsions, which are viscous solutions containing silver halide and gelatin as a base, air bubbles are dissolved in the solutions and eliminated only by feeding the solutions by pressurization, and air bubbles are scarcely formed even when the solutions are placed under atmospheric pressure again for coating. However, as for the coating solution for the image-forming layer containing dispersion of silver salt of organic acid, polymer latex and so forth, which is preferably used in the present invention, only feeding of it by pressurization is likely to result in insufficient degassing. Therefore, it is preferably fed so that air/liquid interfaces should not be produced, while giving ultrasonic vibration to perform degassing.

In the present invention, the degassing of a coating solution is preferably performed by a method where the coating solution is degassed under reduced pressure before coating, and further the solution is maintained in a pressurized state at a pressure of 1.5 kg/cm$^2$ or more and continuously fed so that air/liquid interfaces should not be formed, while giving ultrasonic vibration to the solution. Specifically, the method disclosed in JP-B-55-6405 (from page 4, line 20 to page 7, line 11) is preferred. As an apparatus for performing such degassing, the apparatus disclosed in Japanese Patent Application No. 10-290003, examples and FIG. 3, is preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$. Ultrasonic wave given to the solution should have a sound pressure of 0.2 V or more, preferably 0.5 V to 3.0 V. Although a higher sound pressure is generally preferred, an unduly high sound pressure provides high temperature portions due to cavitation, which may causes fogging. While frequency of the ultrasonic wave is not particularly limited, it is usually 10 kHz or higher, preferably 20 kHz to 200 kHz. The degassing under reduced pressure means a process where a coating solution is placed in a sealed tank (usually a tank in which the solution is prepared or stored) under reduced pressure to increase diameters of air bubbles in the coating solution so that degassing should be attained by buoyancy imparted to the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg. Time under the reduced pressure is 30 minutes or more, preferably 45 minutes or more, and its upper limit is not particularly limited.

In the present invention, the image-forming layer, protective layer for the image-forming layer, undercoat layer and back layer may contain a dye in order to prevent halation and so forth as disclosed in JP-A-11-84573, paragraphs 0204–0208 and Japanese Patent Application No. 11-106881, paragraphs 0240–0241.

Various dyes and pigments can be used for the image-forming layer for improvement of color tone and prevention of irradiation. While any dyes and pigments may be used for the image-forming layer, the compounds disclosed in JP-A-11-119374, paragraphs 0297, for example, can be used. These dyes may be added in any form such as solution, emulsion, solid microparticle dispersion and macromolecule mordant mordanted with the dyes. Although the amount of these compounds is determined by the desired absorption, they are preferably used in an amount of $1\times10^{-6}$ g to 1 g per 1 m$^2$, in general.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 can be used. There can also be used a method of reducing density obtained with a dye by thermal decoloration as disclosed in Belgian Pat. No. 733,706, a method of reducing the density by decoloration utilizing light irradiation as disclosed in JP-A-54-17833 and so forth.

When the photothermographic material of the present invention after heat development is used as a mask for the production of printing plate from a PS plate, the photothermographic material after heat development carries information for setting up light exposure conditions of platemaking machine for PS plates or information for setting up platemaking conditions including transportation conditions of mask originals and PS plates as image information. Therefore, in order to read such information, densities (amounts) of the aforementioned irradiation dye, halation dye and filter dye are limited. Because the information is read by LED or laser, Dmin (minimum density) in a wavelength region of a sensor must be low, i.e., the absorbance must be 0.3 or less. For example, a platemaking machine S-FNRIII produced by Fuji Photo Film Co., Ltd. uses a light source having a wavelength of 670 nm for a detector for detecting resister marks and a bar code reader. Further, platemaking machines of APML series produced by Shimizu Seisaku Co., Ltd. utilize a light source at 670 nm as a bar code reader. That is, if Dmin (minimum density) around 670 nm is high, the information on the film cannot be correctly detected, and thus operation errors such as transportation failure, light exposure failure and so forth occurs in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

In the present invention, as the exposure apparatus used for the imagewise light exposure, any apparatus may be used so long as it is an exposure apparatus enabling light exposure with an exposure time of $10^{-7}$ second or shorter. However, a light exposure apparatus utilizing a laser diode (LD) or a light emitting diode (LED) as a light source is preferably used in general. In particular, LD is more preferred in view of high output and high resolution. Any of these light sources may be used so long as they can emit a light of electromagnetic wave spectrum of desired wavelength range. For example, as for LD, dye lasers, gas lasers, solid state lasers, semiconductor lasers and so forth can be used.

The light exposure in the present invention is performed with overlapped light beams of light sources. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM). In the present invention, it is preferred that this overlap coefficient is 0.2 or more.

The scanning method of the light source of the light exposure apparatus used in the present invention is not particularly limited, and the cylinder external surface scanning method, cylinder internal surface scanning method, flat surface scanning method and so forth can be used. Although the channel of light source may be either single channel or multichannel, a multichannel is preferably used for the cylinder external surface scanning method.

The photothermographic material of the present invention shows low haze upon the light exposure, and therefore it is likely to generate interference fringes. As techniques for preventing such interference fringes, there are known a technique of obliquely irradiating a photosensitive material with a laser light as disclosed in JP-A-5-113548, a technique of utilizing a multimode laser disclosed in WO95/31754 and so forth, and these techniques are preferably used.

Although any method may be used for the heat development process of the image-forming method used for the present invention, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, W097/28489, W097/28488 and W097/28487. Particularly preferred embodiments are the heat development apparatuses of non-contact type. The temperature for the development is preferably 80° C. to 250° C., more preferably 100° C. to 140° C. The development time is preferably 1 to 180 seconds, more preferably 10 to 90 seconds.

As a method for preventing uneven development due to dimensional change of the photothermographic material during the heat development, it is effective to employ a method for forming images wherein the material is heated at a temperature of 80° C. or higher but lower than 115° C. for 5 seconds or more so as not to develop images, and then subjected to heat development at 110–140° C. to form images (so-called multi-step heating method).

Since the photothermographic material of the present invention is subjected to a high temperature of 110° C. or higher during the heat development, a part of the components contained in the material or a part of decomposition products produced by the heat development are volatilized. It is known that these volatilized components invite various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or suitably control air flows in the heat development apparatus. These methods may be effectively used in combination.

WO95/30933, WO97/21150 and International Patent Publication in Japanese (Kohyo) No. 10-500496 disclose use of a filter cartridge having binding absorption particles and having a first vent for taking up volatilized components and a second vent for discharging them in heating apparatus for heating a photothermographic material by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention.

Further, U.S. Pat. No. 4,518,845 and JP-B-3-54331 disclose structures comprising means for eliminating vapor from a photothermographic material, pressing means for pressing a photothermographic material to a heat-conductive member and means for heating the heat-conductive member. Further, WO98/27458 discloses elimination of components volatilized from a photothermographic material and increasing fog from a surface of the photothermographic material. These techniques are also preferably used for the present invention.

An example of the structure of heat development apparatus used for the heat development of the photothermographic material of the present invention is shown in FIG. 1. FIG. 1 depicts a side view of a heat development apparatus. The heat development apparatus shown in FIG. 1 comprises carrying-in roller pairs 11 (upper rollers are silicone rubber rollers, and lower rollers are aluminum heating rollers), which carry a photothermographic material 10 into the heating section while making the material in a flat shape and preheating it, and carrying-out roller pairs 12, which carry out the photothermographic material 10 after heat development from the heating section while maintaining the material to be in a flat shape. The photothermographic material 10 is heat-developed while it is conveyed by the carrying-in roller pairs 11 and then by the carrying-out roller pairs 12. A conveying means for carrying the photothermographic material 10 under the heat development is provided with multiple rollers 13 so that they should be contacted with the surface of the image-forming layer side, and a flat surface 14 adhered with non-woven fabric (composed of, for example, aromatic polyamide, Teflon etc.) or the like is provided on the opposite side so that it should be contacted with the opposite back surface. The photothermographic material 10 is conveyed by driving of the multiple rollers 13 contacted with the surface of the image-forming layer side, while the back surface slides on the flat surface 14. Heaters 15 are provided over the rollers 13 and under the flat surface 14 so that the photothermographic material 10 should be heated from the both sides. Examples of the heating means include panel heaters and so forth. While clearance between the rollers 13 and the flat surface 14 may vary depending on the material of the flat surface member, it is suitably adjusted to a clearance that allows the conveyance of the photothermographic material 10. The clearance is preferably 0–1 mm.

The materials of the surfaces of the rollers 13 and the member of the flat surface 14 may be composed of any materials so long as they have heat resistance and they should not cause any troubles in the conveyance of the photothermographic material 10. However, the material of the roller surface is preferably composed of silicone rubber, and the member of the flat surface is preferably composed of non-woven fabric made of aromatic polyamide or Teflon (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. Temperature of the preheating section A locating upstream from the heat development section B is preferably controlled to be lower than the heat development temperature (for example, lower by about 10–30° C. ), and temperature and heat development time are desirably adjusted so that they should be sufficient for evaporating moisture contained in the photothermographic material 10. The temperature is also preferably adjusted to be higher than the glass transition temperature (Tg) of the support of the photothermographic material 10 so that uneven development should be prevented. Temperature distribution of the preheating section and the heat development section is preferably ±1° C. or less, more preferably ±0.5° C. or less.

Moreover, guide panels 16 are provided downstream from the heat development section B, and a gradual cooling section C having the carrying-out roller pairs 12 and guide panels 16 are provided.

The guide panels 16 are preferably composed of a material of low heat conductivity, and it is preferred that the cooling is performed gradually so as not to cause deformation of the photothermographic material 10. The cooling rate is preferably 0.5–10° C./second.

The heat development apparatus was explained with reference to the example shown in the drawing. However, the apparatus is not limited to the example, and the heat development apparatus used for the present invention may have a variety of structures such as one disclosed in JP-A-7-13294. For the multi-stage heating method, which is preferably used for the present invention, the photothermographic material may be successively heated at different temperatures in such an apparatus as mentioned above, which is provided with two or more heat sources at different temperatures.

EXAMPLES

The present invention will be further specifically explained with reference to the following examples. The materials, regents, ratios, procedures and so forth shown in the following examples can be optionally changed so long as such change does not depart from the spirit of the present invention. Therefore, the scope of the present invention is not limited by the following examples.

Example 1

Preparation of Silver halide emulsion A

In 700 ml of water, 11 g of alkali-treated gelatin (calcium content: 2700 ppm or less), 30 mg of potassium bromide and 1.3 g of sodium 4-methylbenzenesulfonate were dissolved. After the solution was adjusted to pH 6.5 at a temperature of 40° C., 159 ml of an aqueous solution containing 18.6 g of silver nitrate and an aqueous solution containing 1 mol/l of potassium bromide, $5\times10^{-6}$ mol/l of $(NH_4)_2RhCl_5(H_2O)$ and $2\times10^{-5}$ mol/l of $K_3IrCl_6$ were added by the control double jet method over 6 minutes and 30 seconds while pAg was maintained at 7.7. Then, 476 ml of an aqueous solution containing 55.5 g of silver nitrate and an aqueous solution containing 1 mol/l of potassium bromide and $2\times10^{-5}$ mol/l of $K_3IrCl6$ were added by the control double jet method over 28 minutes and 30 seconds while pAg was maintained at 7.7. Then, the pH was lowered to cause coagulation precipitation to effect desalting, 51.1 g of low molecular weight gelatin having an average molecular weight of 15,000 (calcium content: 20 ppm or less) was added, and pH and pAg were adjusted to 5.9 and 8.0, respectively. The grains obtained were cubic grains having a mean grain size of 0.08 $\mu$m, variation coefficient of 9% for projected area and a [100] face ratio of 90%.

The temperature of the silver halide grains obtained as described above was raised to 60° C., and the grains were added with 76 $\mu$mol per mole of silver of sodium benzenethiosulfonate. After 3 minutes, 71 $\mu$mol of triethylthiourea was further added, and the grains were ripened for 100 minutes, then added with $5\times10^{-4}$ mol of 4-hydroxy-6-methyl-1,3,3a,7-tetrazaindene and 0.17 g of Compound A, and cooled to 40° C.

Then, while the mixture was maintained at 40° C., potassium bromide (added as aqueous solution), the following Sensitizing Dye A (added as solution in ethanol) and Compound B (added as solution in methanol) were added in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsion A.

Sensitizing dye A

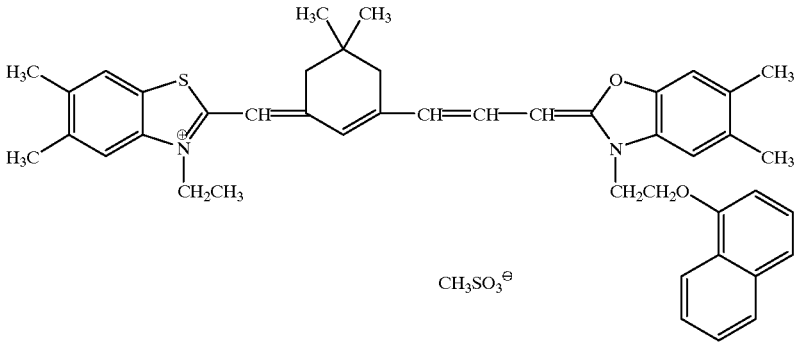

Compound A

Compound B

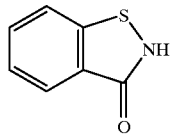

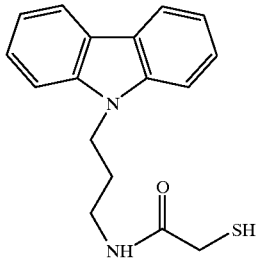

Compound AA

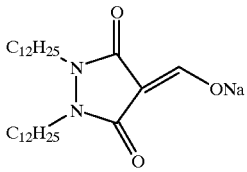

Preparation of Silver behenate dispersion A 87.6 g of behenic acid (Edenor C22-85R, trade name, produced by Henkel Co.), 423 ml of distilled water, 49.2 ml of 5 mol/L aqueous solution of NaOH and 120 ml of tert-butanol were mixed and allowed to react with stirring at 75° C. for one hour to obtain a solution of sodium behenate. Separately, 206.2 ml of an aqueous solution containing 40.4 g of silver nitrate was prepared and kept at 10° C. A mixture of 635 ml of distilled water and 30 ml of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In this operation, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and added in such a manner that only the aqueous solution of sodium behenate should be added for 9 minutes and 30 seconds after finishing the addition of the aqueous silver nitrate solution. During the addition, the outside temperature was controlled so that the temperature in the reaction vessel should be 30° C. and the liquid temperature should not be raised. The piping of the addition system for the sodium behenate solution was warmed by steam trace and the amount of steam was controlled such that the liquid temperature at the outlet orifice of the addition nozzle should be 75° C. The temperature of the piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions were also controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by suction filtration and the solid content was washed with water until electric conductivity of the filtrate became 30 /μS/cm. The solid content obtained as described above was stored as a wet cake without being dried.

When the shape of the obtained silver behenate grains was evaluated by an electron microscopic photography, the grains were scaly crystals having a mean diameter of projected areas of 0.52 μm, mean thickness of 0.14 μm and variation coefficient of 15% for mean diameter as spheres.

Then, dispersion of silver behenate was prepared as follows. To the wet cake corresponding to 100 g of the dry solid content was added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH; trade name, produced by Microfluidex International Corporation, using G10Z interaction chamber) with a pressure controlled to be 1750 kg/cm$^2$ to obtain Silver behenate dispersion A. A desired dispersion temperature was achieved by providing coiled heat exchangers fixed before and after the interaction chamber as cooling means and controlling the temperature of the refrigerant.

The silver behenate grains contained in Silver behenate dispersion A obtained as described above were grains having a volume weight mean diameter of 0.52 /μm and variation coefficient of 15%. The measurement of the grain size was carried out by using Master Sizer X produced by Malvern Instruments Ltd. When the grains were evaluated by an electron microscopic photography, the ratio of the long side to the short side was 1.5, the grain thickness was 0.14 μm, and a mean aspect ratio (ratio of diameter as sphere of projected area of grain and grain thickness) was 5.1.

Preparation of solid microparticle dispersion of reducing agent represented by the formula (1)

10 kg of a reducing agent represented by the formula (1) (type is shown in Table 1) and 10 kg of 20 weight % aqueous solution of denatured polyvinyl alcohol (Poval MP203, produced by Kuraray Co. Ltd.) were added with 16 kg of water, and the mixture was mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 3 hours and 30 minutes. Then, the slurry was added with 4 g of benzoisothiazolinone sodium salt and water so that the concentration of the reducing agent represented by the formula (1) should become 25 weight % to obtain a solid microparticle dispersion of reducing agent represented by the formula (1). The particles of the reducing agent represented by the formula (1) contained in the dispersion obtained as described above had a median diameter of 0.44 μm, maximum particle diameter of 2.0 μm or shorter and variation coefficient of 19% for mean particle diameter. The obtained reducing agent dispersion was filtered through a polypropylene filter having a pore size of 3.0 μm to remove dusts and so forth, and stored.

Preparation of solid microparticle dispersion of phenol compound represented by the formula (2)

10 kg of a phenol compound represented by the formula (2) (type is shown in Table 1) and 10 kg of 20 weight % aqueous solution of denatured polyvinyl alcohol (Poval MP203, produced by Kuraray Co. Ltd.) were added with 16 kg of water, and the mixture was mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 3 hours and 30 minutes. Then, the slurry was added with 4 g of benzoisothiazolinone sodium salt and water so that the concentration of the phenol compound represented by the formula (2) should become 25 weight % to obtain a solid microparticle dispersion of the phenol compound represented by the formula (2). The particles of the phenol compound represented by the formula (2) contained in the dispersion obtained as described above had a median diameter of 0.44 μm, maximum particle diameter of 2.0 μm or shorter and variation coefficient of 19% for mean particle diameter. The obtained dispersion was filtered through a polypropylene filter having a pore size of 3.0 μm to remove dusts and so forth, and stored.

Preparation of solid microparticle dispersion of Organic polyhalogenated compound A 10 kg of Organic polyhalogenated compound A [tribromomethyl(4-(2,4,6-trimethylphenylsulfonyl)phenyl)-sulfone], 10 kg of 20 weight % aqueous solution of denatured polyvinyl alcohol (Poval MP203, produced by Kuraray Co. Ltd.), 639 g of 20 weight % aqueous solution of sodium triisopropylnaphthalenesulfonate, 400 g of Safinol 104E (Nisshin Kagaku Co.), 640 g of methanol and 16 kg of water were mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 5 hours. Then, the slurry was added with water so that the concentration of Organic polyhalogenated compound A should become 25 weight % to obtain solid microparticle dispersion of Organic polyhalogenated compound A. The particles of Organic polyhalogenated compound A contained in the dispersion obtained as described above had a median diameter of 0.36 μm, maximum particle diameter of 2.0 μm or shorter and variation coefficient of 18% for mean particle diameter. The obtained dispersion was filtered through a polypropylene filter having a pore size of 3.0 μm to remove dusts and so forth, and stored.

Preparation of solid microparticle dispersion of Organic polyhalogenated compound B 5 kg of Organic polyhalogenated compound B [tribromomethylnaphthylsulfone], 2.5 kg of 20 weight % aqueous solution of denatured polyvinyl alcohol (Poval MP203, produced by Kuraray Co. Ltd.), 213 g of 20 weight % aqueous solution of sodium triisopropylnaphthalenesulfonate and 10 kg of water were mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 5 hours. Then, the slurry was added with 2.5 g of benzoisothiazolinone sodium salt and water so that the concentration of Organic polyhalogenated compound B should become 20 weight % to obtain solid microparticle dispersion of Organic polyhalogenated compound B. The particles of the organic polyhalogenated compound contained in the dispersion obtained as described above had a median diameter of 0.38 μm, maximum particle diameter of 2.0 μm or shorter and variation coefficient of 20% for mean particle diameter. The obtained dispersion was filtered through a polypropylene filter having a pore size of 3.0 μm to remove dusts and so forth, and stored.

Preparation of solid microparticle dispersion of Compound Z 3.5 kg of R-054 (Sanko Co., Ltd.) containing 85 weight % of Compound Z was added with 1 kg of denatured polyvinyl alcohol (Poval MP203, produced by Kuraray Co. Ltd.) and 15 kg of water, and the mixture was mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 7 hours. Then, the slurry was added with water so that the concentration of Compound Z should become 10 weight % to obtain solid microparticle dispersion of Compound Z. The particles of Compound Z contained in the dispersion obtained as described above had a median diameter of 0.45 μm, maximum particle diameter of 4.0 μm or shorter and variation coefficient of 17% for mean particle diameter. The obtained dispersion was filtered through a polypropylene filter having a pore size of 3.0 μm to remove dusts and so forth, and stored.

Preparation of dispersion of phthalazine compound represented by the formula (3)

87.9 g of water was added with 2.0 g of denatured polyvinyl alcohol (Poval MP203, produced by Kuraray Co., Ltd.) with stirring so that the denatured polyvinyl alcohol should not coagulate, and the mixture was mixed by stirring for 10 minutes. Then, the mixture was heated until the internal temperature reached 50° C., and stirred for 1 hour to attain uniform dissolution. The internal temperature was lowered to 40° C. or lower, and the mixture was added with 3.0 g of 20 weight % aqueous solution of sodium tripropylnaphthalenesulfonate, and 7.14 g of 6-isopropylphthalazine (70% aqueous solution) was added as a phthalazine compound represented by the formula (3). The mixture was stirred for 30 minutes to obtain a transparent dispersion. The obtained dispersion was filtered through a polypropylene filter having a pore size of 3.0 μm to remove dusts and so forth, and stored as dispersion of 6-isopropylphthalazine compound.

Preparation of solid microparticle dispersion of ultrahigh contrast agent 4 kg of ultrahigh contrast agent (Compound AA) was added with 1 kg of denatured polyvinyl alcohol (Poval PVA-217, produced by Kuraray Co., Ltd.) and 36 kg of water and the mixture was mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 12 hours. Then, the slurry was added with 4 g of benzoisothiazolinone sodium salt and water so that the concentration of the ultrahigh contrast agent should become 10 weight % to obtain solid microparticle dispersion of the ultrahigh contrast agent. The particles of the ultrahigh contrast agent contained in the dispersion obtained as described above had a median diameter of 0.34 μm, maximum particle diameter of 3.0 μm or less, and variation coefficient of 19% for the particle diameter. The obtained dispersion was filtered through a polypropylene filter having a pore size of 3.0 μm to remove dusts and so forth, and stored.

Preparation of coating solution for image-forming layer

Silver behenate dispersion A prepared above was added with the following binder, components and Silver halide emulsion A in the indicated amounts per mole of silver in Silver behenate dispersion A, and added with water to prepare a coating solution for image-forming layer. After the completion, the solution was degassed under reduced pressure of −350 mmHg for 60 minutes. The coating solution showed pH of 7.7 and viscosity of 45 cp at 25° C.

| | |
|---|---|
| Binder (LACSTAR 3307B, SBR latex, produced by Dai-Nippon Ink & Chemicals, Inc., glass transition temperature: 17° C.) | 397 g as solid |
| Reducing agent of the formula (1) | 404 mmol as solid |
| Phenol compound of the formula (2) | 80 mmol as solid |
| Organic polyhalogenated compound A | 43.5 g as solid |
| Organic polyhalogentaed compound B | 13.5 g as solid |
| Sodium ethylthiosulfonate | 0.30 g |
| Benzotriazole | 1.04 g |
| Polyvinyl alcohol (PVA-235, produced by Kuraray Co., Ltd.) | 10.8 g |
| 6-Isopropylphthalazine | 12.8 g as solid |
| Sodium dihydrogenorthophosphate dihydrate | 0.37 g |
| Compound Z | 9.7 g as solid |
| Ultrahigh contrast agent (Compound AA) | 0.03 mole as solid |
| Dye A (added as a mixture with low molecular weight gelatin having mean molecular weight of 15000) | Amount giving optical density of 0.3 at 783 nm (about 0.37 g) |
| Silver halide emulsion A | 0.06 mole as Ag |
| Compound C | 2.0 g |

-continued

| | |
|---|---|
| Compound A as preservative | 40 ppm in the coating solution (2.5 mg/m$^2$ as coated amount) |
| Methanol | 2 weight % as to total solvent amount in the coating solution |
| Ethanol | 1 weight % as to total solvent amount in the coating solution |

(The coated film showed a glass transition temperature of 17° C.)

Compound Z

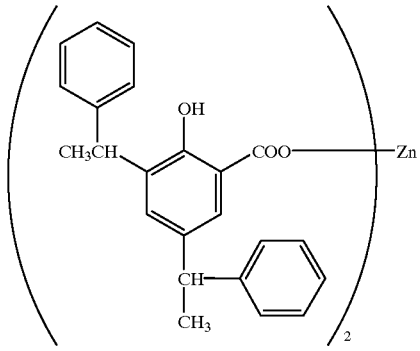

Dye A

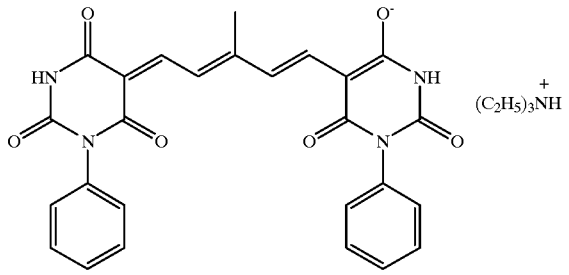

Compound C

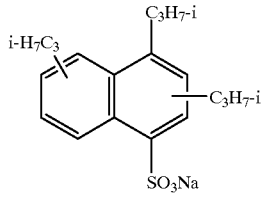

Preparation of coating solution for lower protective layer 943 g of a polymer latex solution containing copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and containing Compound D as a film-forming aid in an amount of 15 weight % relative to solid content of the latex, glass transition temperature of the coating solution: 24° C.) was added with water, 1.62 g of Compound E, 1.98 g of matting agent (polystyrene particles, mean particle diameter: 7 μm, variation coefficient of 8% for mean particle diameter) and 29.4 g of polyvinyl alcohol (PVA-235, Kuraray Co., Ltd.) and further added with water to form a coating solution (containing 2 weight % of methanol solvent). After the completion, the coating solution was degassed under reduced pressure of −400 mmHg for 60 minutes. The coating solution showed pH of 5.5 and viscosity of 40 cp at 25° C.

Preparation of coating solution for upper protective layer 649 g of a polymer latex solution containing copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and containing Compound D as a film-forming aid in an amount of 15 weight % relative to solid content of the latex, glass transition temperature of the coating solution: 24° C.) was added with water, 6.30 g of 30 weight % solution of carnauba wax (Cellosol 524, silicone content: less than 5 ppm, Chukyo Yushi Co., Ltd.), 0.23 g of Compound C, 7.95 g of Compound F, 0.93 g of Compound G, 1.8 g of Compound H, 1.18 g of matting agent (polystyrene particles, mean particle diameter: 7 μm, variation coefficient of 8% for mean particle diameter) and 12.1 g of polyvinyl alcohol (PVA-235, Kuraray Co., Ltd.), and further added with water to form a coating solution (containing 1.5 weight % of methanol solvent). After the completion, the coating solution was degassed under reduced pressure of −400 mmHg for 60 minutes. The coating solution showed pH of 2.8 and viscosity of 30 cp at 25° C.

Compound D

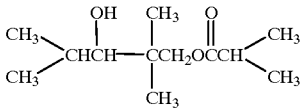

Compound E

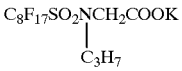

Compound F

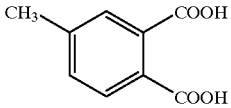

Compound G

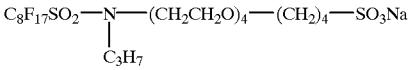

Compound H

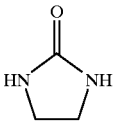

Preparation of polyethylene terephthalate (PET) support having back layer and undercoat layer (1) Preparation of PET Support Polyethylene terephthalate having intrinsic viscosity of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having such a thickness that the film should have a thickness of 120 μm after thermal fixation.

The film was stretched along the longitudinal direction by 3.3 times at 110° C. using rollers of different peripheral speeds, and then stretched along the transverse direction by 4.5 times at 130° C. using a tenter. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of PET support having a width of 2.4 m, length of 3500 m, and thickness of 120 μm was obtained.

(2) Preparation of undercoat layers and back layers (2-1) First undercoat layer

The aforementioned support was coated with a coating solution having the following composition in an amount of 6.2 ml/m$^2$, and dried at 125° C. for 30 seconds, 150° C. for 30 seconds, and 185° C. for 30 seconds.

| | |
|---|---|
| Latex A | 280 g |
| KOH | 0.5 g |
| Polystyrene microparticles (mean particle diameter; 2 μm, variation coefficient of 7% for mean particle diameter) | 0.03 g |
| 2,4-Dichloro-6-hydroxy-s-triazine | 1.8 g |
| Distilled water | Amount giving total weight of 1000 g |

(2-2) Second undercoat layer

A coating solution having the following composition was coated on the first undercoat layer in an amount of 5.5 ml/m$^2$ and dried at 125° C. for 30 seconds, 150° C. for 30 seconds, and 170° C. for 30 seconds.

| | |
|---|---|
| Deionized gelatin ($Ca^{2+}$ content; 0.6 ppm, jelly strength; 230 g) | 10.0 g |
| Acetic acid (20% aqueous solution) | 10.0 g |
| Compound Bc-A | 0.04 g |
| Methylcellulose (2% aqueous solution) | 25.0 g |
| Polyethyleneoxy compound | 0.3 g |
| Distilled water | Amount giving total weight of 1000 g |

(2-3) First back layer

The surface of the support opposite to the surface coated with the undercoat layers was subjected to a corona discharge treatment of 0.375 kV●A●minute/m$^2$, and a coating solution having the following composition was coated on that surface in an amount of 13.8 ml/m$^2$, and dried at 125° C. for 30 seconds, 150° C. for 30 seconds, and 185° C. for 30 seconds.

| | |
|---|---|
| Julimer ET-410 (30% aqueous dispersion Nihon Junyaku Co., Ltd.) | 23.0 g |
| Alkali-treated gelatin (molecular weight; about 10000, $Ca^{2+}$ content; 30 ppm) | 4.44 g |
| Deionized gelatin ($Ca^{2+}$ content; 0.6 ppm) | 0.84 g |
| Compound Bc-A | 0.02 g |
| Dye Bc-A | Amount giving optical density of 1.3–1.4 at 783 nm, about 0.88 g |
| Polyoxyethylene phenyl ether | 1.7 g |
| Water-soluble melamine compound | 15.0 g |

-continued

| | |
|---|---|
| (Sumitex Resin M-3, 8% aqueous solution, Sumitomo Chemical Co., Ltd.) | |
| Aqueous dispersion of Sb-doped $SnO_2$ acicular grains (FS-10D, Ishihara Sangyo Kaisha, Ltd.) | 24.0 g |
| Polystyrene microparticles (mean diameter; 2.0 μm, variation coefficient of 7% for mean particle diameter) | 0.03 g |
| Distilled water | Amount giving total weight of 1000 g |

(2-4) Second back layer

A coating solution having the following composition was coated on the first back layer in an amount of 5.5 ml/m$^2$ and dried at 125° C. for 30 seconds, 150° C. for 30 seconds, and 170° C. for 30 seconds.

| | |
|---|---|
| Julimer ET-410 (30% aqueous dispersion Nihon Junyaku Co., Ltd.) | 57.5 g |
| Polyoxyethylene phenyl ether | 1.7 g |
| Water-soluble melamine compound (Sumitex Resin M-3, 8% aqueous solution, Sumitomo Chemical Co., Ltd.) | 15.0 g |
| Cellosol 524 (30% aqueous solution, Chukyo Yushi Co., Ltd.) | 6.6 g |
| Distilled water | Amount giving total weight of 1000 g |

(2-5) Third back layer

The same coating solution as the first undercoat layer was coated on the second back layer in an amount of 6.2 ml/m$^2$ and dried at 125° C. for 30 seconds, 150° C. for 30 seconds, and 185° C. for 30 seconds.

(2-6) Fourth back layer

A coating solution having the following composition was coated on the third back layer in an amount of 13.8 ml/m$^2$ and dried at 125° C. for 30 seconds, 150° C. for 30 seconds, and 170° C. for 30 seconds.

| | |
|---|---|
| Latex B | 286 g |
| Compound Bc-B | 2.7 g |
| Compound Bc-C | 0.6 g |
| Compound Bc-D | 0.5 g |
| 2,4-Dichloro-6-hydroxy-s-triazine | 2.5 g |
| Polymethyl methacrylate (10% aqueous dispersion, mean particles diameter: 5.0 μm, variation coefficient of 7% for mean particle diameter) | 7.7 g |
| Distilled water | Amount giving total weight of 1000 g |

Dye Bc-A

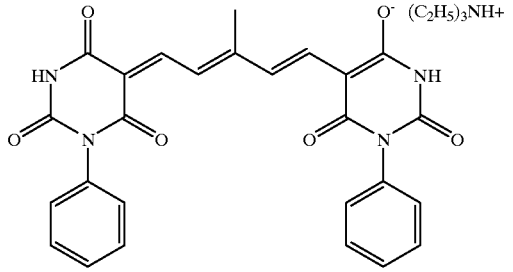

Compound Bc-A

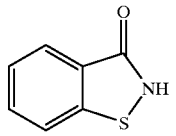

Compound Bc-B $C_{18}H_{37}OSO_3Na$

Compound Bc-C $C_8F_{17}SO_3Li$

Compound Bc-D $C_8F_{17}SO_2—N(C_4H_9)—(CH_2CH_2O)_4(CH_2)_4—SO_3Na$

Latex A

Core/shell type latex comprising 90 weight % of core and 10 weight % of shell, core: vinylidene chloride/methyl acrylate/methyl methacrylate/acrylonitrile/acrylic acid=93/3/3/0.9/0.1 (weight %), shell: vinylidene chloride/methyl acrylate/methyl methacrylate/acrylonitrile/acrylic acid=88/3/3/3/3 (weight %), weight average molecular weight; 38000

Latex B

Latex of copolymer of methyl methacrylate/styrene/2-ethylhexyl acrylate/2-hydroxyethyl methacrylate/acrylic acid=59/9/26/5/1 (weight %)

(3) Heat treatment during transportation (3-1) Heat treatment

The PET support with back layers and undercoat layers prepared as described above was introduced into a heat treatment zone having a total length of 200 m set at 160° C., and transported at a tension of 2 kg/cm$^2$ and a transportation speed of 20 m/minute.

(3-2) Post-heat treatment

Following the aforementioned heat treatment, the support was subjected to a post-heat treatment by passing it through a zone at 40° C. for 15 seconds, and rolled up. The rolling up tension for this operation was 10 kg/cm$^2$.

Preparation of photothermographic materials

On the second undercoat layer of the aforementioned PET support, the aforementioned coating solution for image-forming layer was coated so that the coated silver amount should be 1.5 g/m$^2$ by the slide bead coating method disclosed in Japanese Patent Application No. 10-292849, FIG. 1. Further, the aforementioned coating solution for lower protective layer was coated on the image-forming layer simultaneously with the coating solution for image-forming layer as stacked layers, so that the coated solid content of the polymer latex should be 1.31 g/m$^2$. Then, the aforementioned coating solution for upper protective layer was coated on the lower protective layer, so that the coated solid content of the polymer latex should be 3.02 g/m$^2$ to obtain a photothermographic material.

After the coating, the layers were dried in a horizontal drying zone (the support was at an angle of 1.5–3° to the horizontal direction of the coating machine) under the following conditions: dry-bulb temperature of 70–75° C., dew point of 8–25° C. and liquid film surface temperature of 35–40° C. for both of the constant rate drying process and the decreasing rate drying process. After the drying, the material was rolled up under the conditions of a temperature of 25±5° C. and relative humidity of 45±10%, and the material was rolled up in such a rolled shape that the image-forming layer should be exposed to the outside so that it should conform to the subsequent processing (image-forming layer outside roll). The relative humidity of the photosensitive material was 20–40% (measured at 25° C.). The obtained photothermographic material showed a film surface pH of 5.0 and Beck's smoothness of 850 seconds for the image-forming layer side. The opposite surface showed a film surface pH of 5.9 and Beck's smoothness of 560 seconds.

Light exposure

The obtained photothermographic material was light exposed for $1.2\times10^{-8}$ second by using a laser light-exposure apparatus of single channel cylindrical internal surface scanning type provided with a semiconductor laser with a beam diameter (FWHM of ½ of beam intensity) of 12.56 $\mu$m, laser output of 50 mW and output wavelength of 783 nm, while the exposure time was adjusted by changing mirror revolution number and the amount of the exposure was adjusted by changing output power. The overlap coefficient of the light exposure was 0.449.

(Heat development)

The light-exposed photothermographic material was heat-developed by using such a heat development apparatus as shown in Fig. 1. The roller surface material of the heat development section was composed of silicone rubber, and the flat surface consisted of Teflon non-woven fabric. The heat development was performed at a transportation line speed of 21.2 mm/second. The heat development treatment was performed in the preheating section for 14.4 seconds (Driving units of the preheating section and the heat development section were independent from each other, and speed difference as to the heat development section was adjusted to −0.5% to −1%. Temperatures of the metallic rollers and processing times for each preheating partwereas follows: first roller, 67° C. for 2.4 seconds; second roller, 82° C. for 2.4 seconds; third roller, 98° C. for 2.4 seconds; fourth roller, 107° C. for 2.4 seconds; fifth roller, 115° C. for 2.4 seconds; and sixth roller, 120° C. for 2.4 seconds), in the heat development section at 120° C. (surface temperature of photothermographic material) for 20.3 seconds, and in the gradual cooling section for 16 seconds (the material was continuously cooled from 120° C. to 60° C. over 16 seconds, and cooling rate was −3.75° C./second). The temperature precision as for the transverse direction was ±0.5° C. As for each roller temperature setting, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the end of the photothermographic material was controlled to be higher than that of the roller center by 1–3° C., so that uniform image density of a finished developed image should be obtained for the whole photothermographic material surface (for example, within a width of 61 cm).

Evaluation of photographic performance

The obtained image was evaluated by using Macbeth TD904 densitometer (visible density). The measurement results were evaluated as Dmin (fog), Dmax (maximum density), and sensitivity (evaluated as a reciprocal of the ratio of the exposure giving a density 0.3 higher than Dmin, and expressed as a relative value based on the value of Photothermographic material 101 shown in Table 1, which was taken as 0 as base line, a positively larger value indicates higher sensitivity).

$$\Delta S_{0.3} = S_{0.3}(\text{Evaluated photothermographic material sample}) - S_{0.3}(\text{Photothermographic material sample 101})$$

The samples according to the present invention showed good photographic properties, i.e., high sensitivity and Dmax (maximum density), and low fog.

TABLE 1

| Photothermographic | Reducing agent | | Photographic property | | |
|---|---|---|---|---|---|
| Material | Type | Type | Dmax | Fog | $\Delta S_{0.3}$ |
| 101 (Comparative) | I-1 | None | 4.3 | 0.22 | 0 (Base) |
| 102 (Comparative) | I-2 | None | 4.2 | 0.23 | 0.01 |
| 103 | I-1 | II-6 | 4.5 | 0.19 | 0.09 |
| 104 | I-1 | II-35 | 4.3 | 0.18 | 0.39 |
| 105 | I-1 | II-22 | 5.0 | 0.17 | 0.18 |
| 106 | I-1 | II-28 | 4.5 | 0.16 | 0.05 |
| 107 | I-1 | II-36 | 4.6 | 0.19 | 0.49 |
| 108 | I-1 | II-33 | 4.8 | 0.20 | 0.78 |
| 109 | I-1 | II-91 | 4.4 | 0.20 | 0.04 |
| 110 | I-1 | II-97 | 4.3 | 0.18 | 0.40 |
| 111 | I-1 | II-93 | 4.7 | 0.16 | 0.25 |
| 112 | I-1 | II-92 | 4.5 | 0.17 | 0.20 |
| 113 | I-1 | II-80 | 4.3 | 0.14 | 0.36 |
| 114 | I-1 | II-118 | 4.5 | 0.16 | 0.31 |
| 115 | I-2 | II-108 | 4.4 | 0.16 | 0.10 |
| 116 | I-4 | II-115 | 4.5 | 0.16 | 0.17 |
| 117 | I-7 | II-117 | 4.5 | 0.16 | 0.05 |
| 118 | I-26 | II-114 | 4.6 | 0.14 | 0.26 |
| 119 | I-2 | II-35 | 4.7 | 0.17 | 0.41 |
| 120 | I-4 | II-35 | 4.9 | 0.18 | 0.37 |

Example 2

The photothermographic materials of Example 1 were produced without using the ultrahigh contrast agent (Compound AA), and evaluated in the same manner as in Example 1. The results are shown in Table 2.

The samples according to the present invention showed good photographic properties, i.e., high sensitivity and Dmax (maximum density), and low fog, also in Example 2.

TABLE 2

| Photothermographic | Reducing agent | | Photographic property | | |
|---|---|---|---|---|---|
| Material | Type | Type | Dmax | Fog | $\Delta S_{0.3}$ |
| 201 (Comparative) | I-1 | None | 1.4 | 0.21 | 0 (Base) |
| 202 (Comparative) | I-2 | None | 1.3 | 0.22 | −0.01 |
| 203 | I-1 | II-6 | 1.5 | 0.18 | 0.02 |
| 204 | I-1 | II-35 | 1.5 | 0.17 | 0.29 |
| 205 | I-1 | II-22 | 1.5 | 0.17 | 0.12 |
| 206 | I-1 | II-28 | 1.5 | 0.16 | 0.05 |
| 207 | I-1 | II-36 | 1.6 | 0.19 | 0.43 |
| 208 | I-1 | II-33 | 1.7 | 0.19 | 0.55 |
| 209 | I-1 | II-91 | 1.5 | 0.19 | 0.03 |
| 210 | I-1 | II-97 | 1.6 | 0.18 | 0.31 |
| 211 | I-1 | II-93 | 1.6 | 0.17 | 0.20 |

TABLE 2-continued

| Photothermographic | Reducing agent | | Photographic property | | |
|---|---|---|---|---|---|
| Material | Type | Type | Dmax | Fog | $\Delta S_{0.3}$ |
| 212 | I-1 | II-92 | 1.7 | 0.17 | 0.31 |
| 213 | I-1 | II-80 | 1.6 | 0.15 | 0.28 |
| 214 | I-1 | II-118 | 1.5 | 0.16 | 0.23 |
| 215 | I-2 | II-108 | 1.5 | 0.16 | 0.05 |
| 216 | I-4 | II-115 | 1.5 | 0.16 | 0.11 |
| 217 | I-7 | II-117 | 1.5 | 0.16 | 0.03 |
| 218 | I-26 | II-114 | 1.6 | 0.15 | 0.23 |
| 219 | I-2 | II-35 | 1.7 | 0.16 | 0.31 |
| 220 | I-4 | II-35 | 1.7 | 0.17 | 0.29 |

The present application claims a priority based on Japanese Patent Application No. 2000-76240 filed on March 17, 2000, the entire content of which is incorporated herein by reference.

What is claimed is:

1. A photothermographic material comprising at least (a) a photosensitive silver halide, (b) a reducible silver salt, (c) a reducing agent represented by the following formula (1), (d) a binder, and (e) a phenol compound represented by the following formula (2) on the same side of a support:

(1)

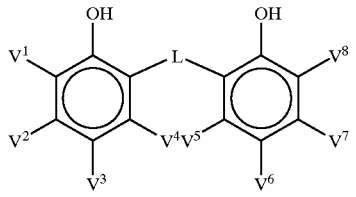

wherein, in the formula (1), $V^1$ to $V^8$ each independently represent hydrogen atom or a substituent, L represents a bridging group consisting of —CH($V^9$)— or —S—, and $V^9$ represents hydrogen atom or a substituent;

(2)

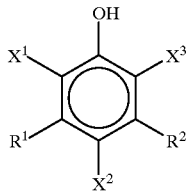

wherein, in the formula (2), $R^1$ and $R^2$ each independently represent hydrogen atom or a substituent, $X^1$ to $X^3$ each independently represent hydrogen atom or a substituent, provided that the substituents represented by $X^1$ to $X^3$ do not represent hydroxy group, and when the substituents represented by $X^1$ to $X^3$ are bonded to the phenol ring via nitrogen atoms, $X^1$ to $X^3$ represent a nitrogen-containing heterocyclic group or a group represented as —NH—C(=O)—$R^4$ where $R^4$ represents a substituent having 8–40 carbon atoms, or the substituents represented by $R^1$, $R^2$ and $X^1$ to $X^3$ may be bound to each other to form a ring.

2. The photothermographic material according to claim 1, which further contains (f) a phthalazine compound represented by the following formula (3):

(3)

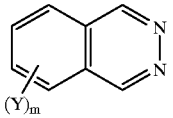

wherein, in the formula (3), Y represents hydrogen atom or a monovalent substituent, m represents an integer of 1 to 6, where (Y)m means that 1–6 of Y independently exist on the phthalazine ring, and when m is 2 or more, adjacent two of Y may form an aliphatic ring, aromatic ring or heterocycle.

3. The photothermographic material according to claim 1, wherein, in the formula (2), at least one of $X^1$ to $X^3$ is a halogen atom, an alkoxy group, an aryloxy group, a heteroaryloxy group, an alkylthio group, an arylthio group, a heterocyclylthio group or a nitrogen-containing heterocyclic group that binds to the phenol ring via nitrogen atom.

4. The photothermographic material according to claim 2, wherein, in the formula (2), at least one of $X^1$ to $X^3$ is a halogen atom, an alkoxy group, an aryloxy group, a heteroaryloxy group, an alkylthio group, an arylthio group, a heterocyclylthio group or a nitrogen-containing heterocyclic group that binds to the phenol ring via nitrogen atom.

5. The photothermographic material according to claim 1, which further contains an ultrahigh contrast agent.

6. The photothermographic material according to claim 2, which further contains an ultrahigh contrast agent.

7. The photothermographic material according to claim 1, wherein the material is prepared by using an aqueous coating solution.

8. The photothermographic material according to claim 1, wherein $V^1$ to $V^8$ are each independently selected from the group consisting of a halgen atom, a linear, branched or cyclic alkyl group having 1–20 carbon atoms, an alkenyl group having 2–20 carbon atoms, an aryl group having 6–30 carbon atoms, an alkoxy group having 1–20 carbon atoms, an aryloxy group having 6–30 carbon atoms, an acyloxy group having 2–20 carbon atoms, an amino group having 0–20 carbon atoms, an acylamino group having 2–20 carbon atoms, a sulfonylamino group having 1–20 carbon atoms, an ureido group having 1–20 carbon atoms, a carbamate group having 2–20 carbon atoms, a carboxyl group, a carbamoyl group having 1–20 carbon atoms, an alkoxycarbonyl group having 2–20 carbon atoms, an acyl group having 2–20 carbon atoms, a sulfo group, a sulfonyl group having 1–20 carbon atoms, a sulfamoyl group having 0–20 carbon atoms, a cyano group, a nitro group, a mercapto group, an alkylthio group having 1–20 carbon atoms, and a heterocyclic group having 2–20 carbon atoms.

9. The photothermographic material according to claim 8, wherein $V^1$ to $V^8$ are each an alkyl group independently selected from the group consisting of methyl, ethyl, n-propyl, isopropyl, sec-butyl, tert-butyl, tert-octyl, n-amyl, tert-amyl, n-dodecyl, n-tridecyl and cyclohexyl.

10. The photothermographic material according to claim 1, wherein $V^9$ is selected from the group consisting of a halgen atom, a linear, branched or cyclic alkyl group having 1–20 carbon atoms, an alkenyl group having 2–20 carbon atoms, an aryl group having 6–30 carbon atoms, an alkoxy group having 1–20 carbon atoms, an aryloxy group having 6–30 carbon atoms, an acyloxy group having 2–20 carbon atoms, an amino group having 0–20 carbon atoms, an acylamino group having 2–20 carbon atoms, a sulfonylamino group having 1–20 carbon atoms, an ureido group having 1–20 carbon atoms, a carbamate group having 2–20 carbon atoms, a carboxyl group, a carbamoyl group having 1–20 carbon atoms, an alkoxycarbonyl group having 2–20 carbon atoms, an acyl group having 2–20 carbon atoms, a sulfo group, a sulfonyl group having 1–20 carbon atoms, a sulfamoyl group having 0–20 carbon atoms, a cyano group, a nitro group, a mercapto group, an alkylthio group having 1–20 carbon atoms, and a heterocyclic group having 2–20 carbon atoms.

11. The photothermographic material according to claim 10, wherein $V^9$ is an alkyl group selected from the group consisting of methyl, ethyl, n-propyl, isopropyl, sec-butyl, tert-butyl, tert-octyl, n-amyl, tert-amyl, n-dodecyl, n-tridecyl, cyclohexyl and 2, 4, 4-trimethylpentyl; an alkenyl group selected from the group consisting of vinyl, allyl, 2-butenyl and 3-pentenyl; an aryl group selected from the group consisting of phenyl, p-methylphenyl and naphthyl; a hydroxyl group; a mercapto group; or an alkylthio group selected from the group consisting of methylthio and butylthio.

12. The photothermographic material according to claim 1, wherein the compound of formula (1) is selected from the group consisting of (I-1)

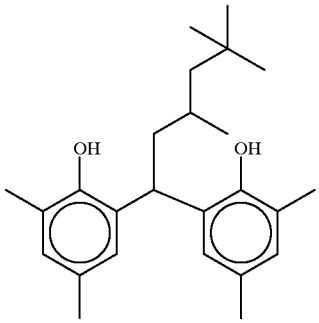

(I-2)

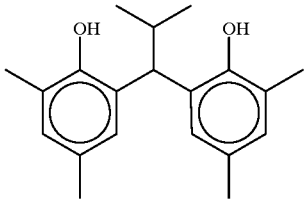

(I-3)

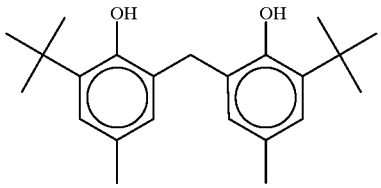

(I-4)

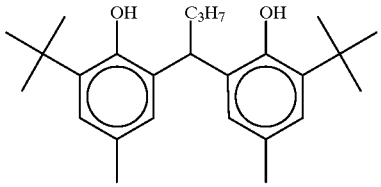

-continued (I-5)

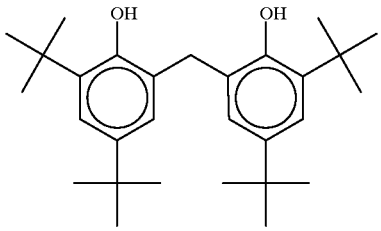

(I-6)

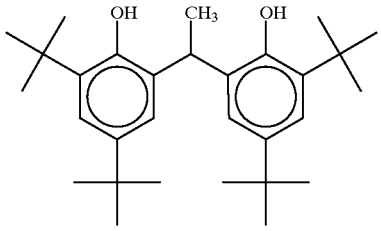

(I-7)

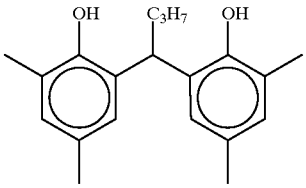

(I-8)

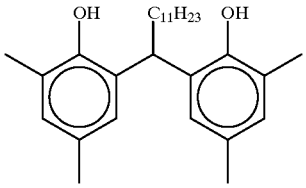

(I-9)

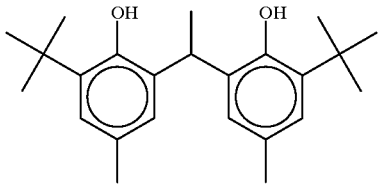

(I-10)

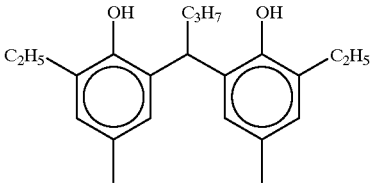

(I-11)

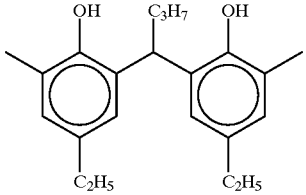

-continued
(I-12)
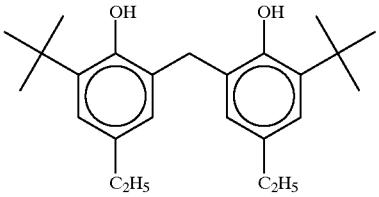
(I-13)
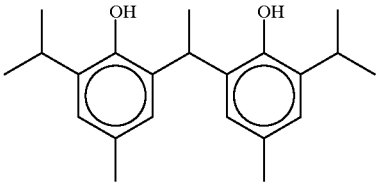
(I-14)
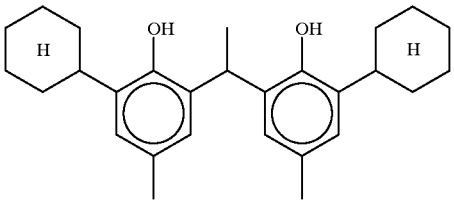
(I-15)
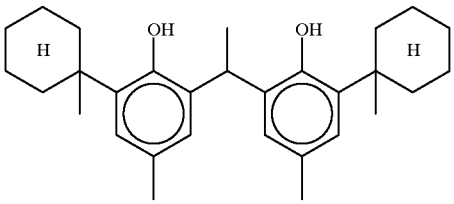
(I-16)
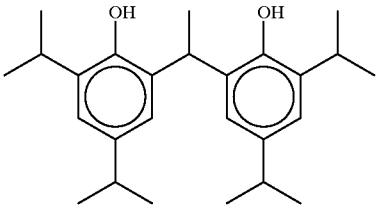
(I-17)
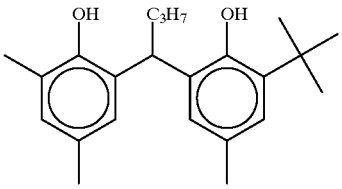
(I-18)
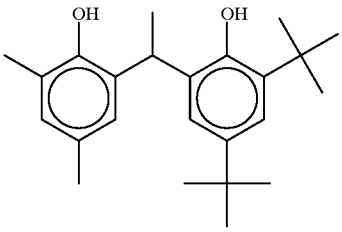
-continued
(I-19)
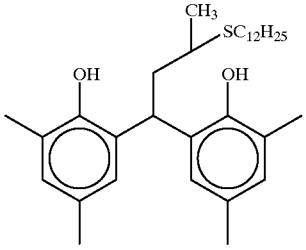
(I-20)
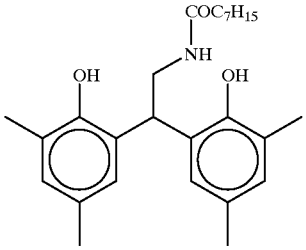
(I-21)
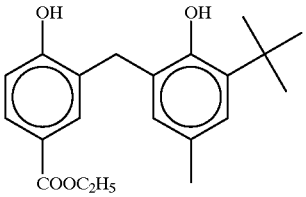
(I-22)
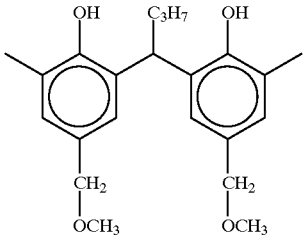
(I-23)
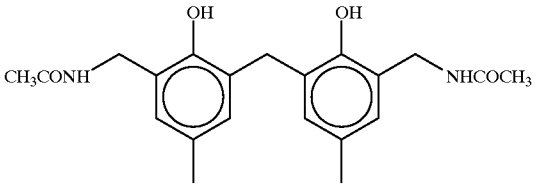
(I-24)
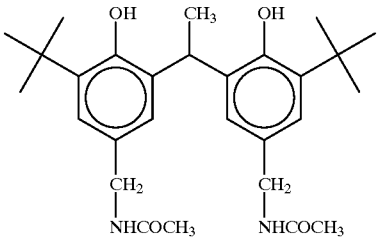

-continued (I-25)

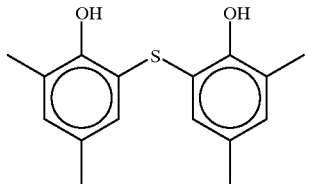

(I-26)

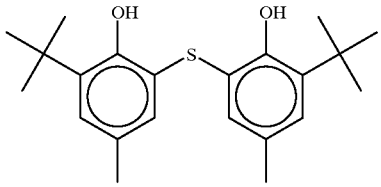

(I-27)

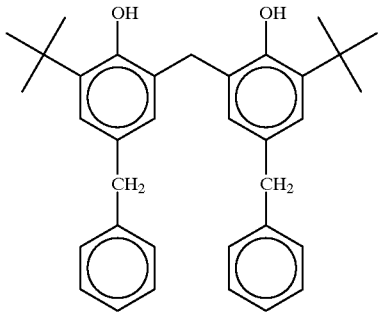

(I-28)

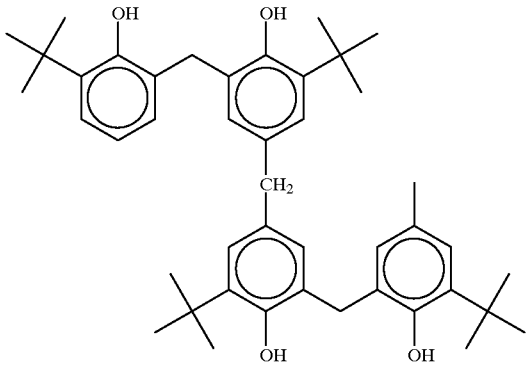

(I-29)

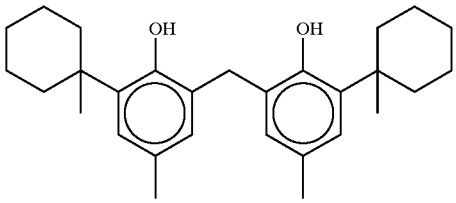

(I-30)

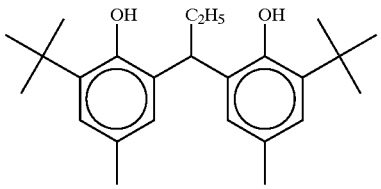

-continued (I-31)

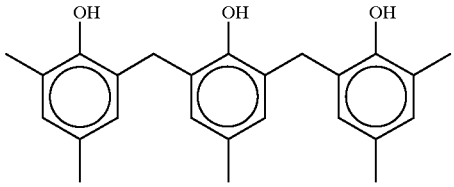

(I-32)

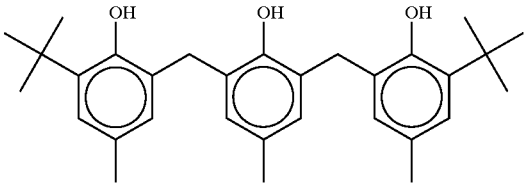

(I-33)

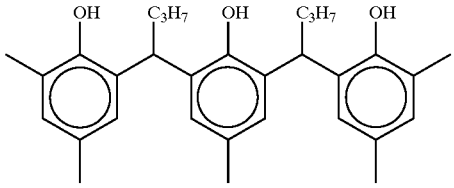

(I-34)

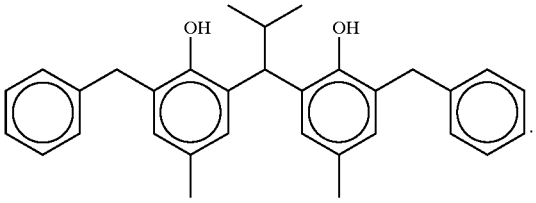

13. The photothermographic material according to claim 1, wherein the compound of formula (1) is present in a concentration of 2 to 40 mole % per mole of silver present on the side having the image-forming layer.

14. The photothermographic material according to claim 1, wherein $R^1$ and $R^2$ are each independently selected from the group consisting of a halogen atom, an alkyl group, an aryl group, an alkoxy group, an aryloxy group, an acyloxy group, an anilino group, an acylamino group, a sulfonylamino group, a carboxyl group, a carbamoyl group, an acyl group, a sulfo group, a sulfonyl group, a sulfamoyl group, a cyano group, a mercapto group, and alkylthio group and a heterocyclic group.

15. The photothermographic material according to claim 1, wherein $X^1$ to $X^3$ are each independently selected from the group consisting of a halogen atom, an alkoxy group, an aryloxy group, a heteroaryloxy group, an alkylthio group, an arylthio group, a heterocyclythio group, and a nitrogen-containing heterocyclic group that binds to the phenol ring via nitrogen atom.

16. The photothermographic material according to claim 1, wherein the compound of formula (2) is selected from the group consisting of (II-1)

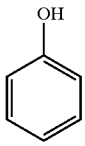

-continued
(II-2)
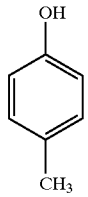
(II-3)
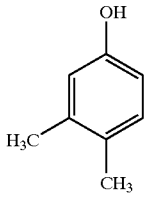
(II-5)
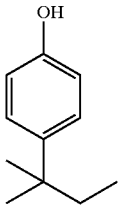
(II-7)
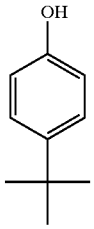
(II-8)
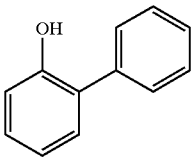
(II-9)
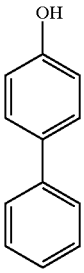
(II-10)
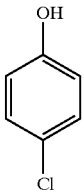
-continued
(II-11)
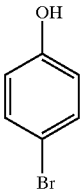
(II-12)
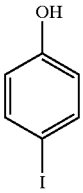
(II-13)
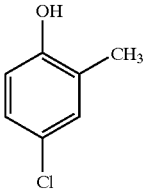
(II-14)
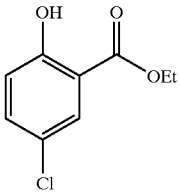
(II-15)
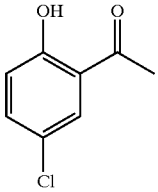
(II-16)
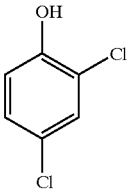
(II-17)
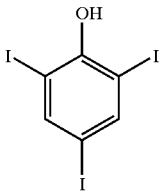
(II-18)
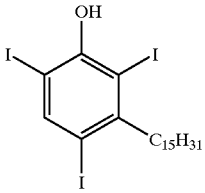

-continued
(II-19)
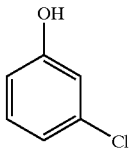
(II-20)
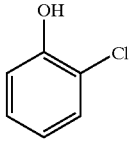
(II-21)
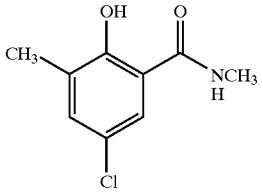
(II-22)
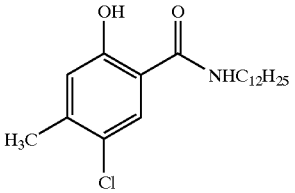
(II-23)
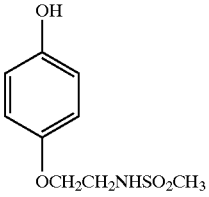
(II-24)
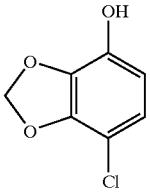
(II-25)
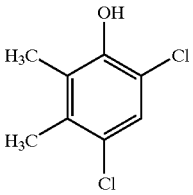
(II-26)
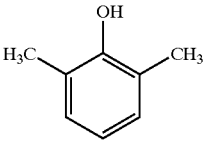
-continued
(II-27)
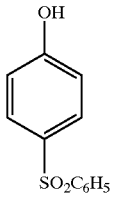
(II-28)
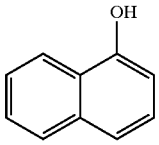
(II-29)
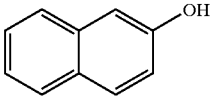
(II-30)
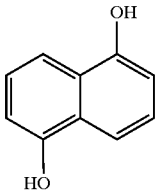
(II-31)
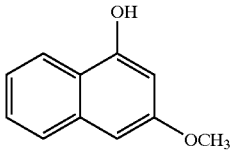
(II-32)
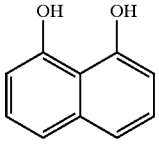
(II-33)
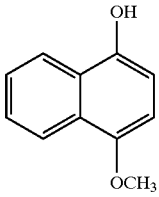
(II-34)
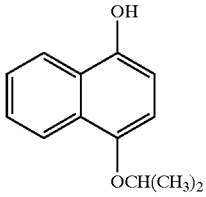
(II-35)
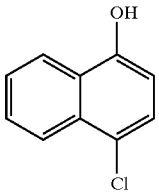

-continued
(II-36)
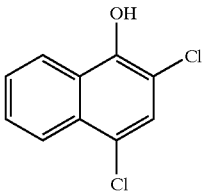
(II-37)
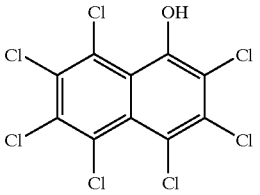
(II-38)
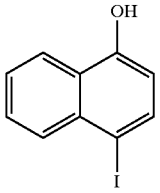
(II-39)
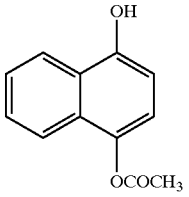
(II-40)
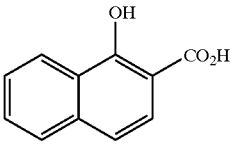
(II-41)
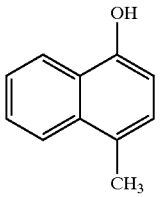
(II-42)
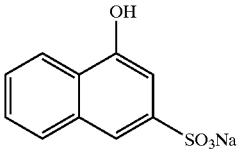
(II-43)
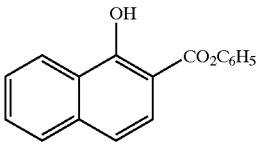
-continued
(II-44)
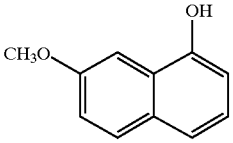
(II-45)
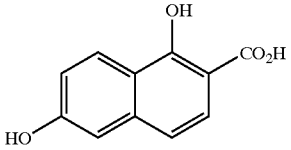
(II-46)
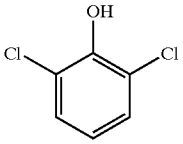
(II-47)
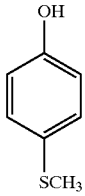
(II-48)
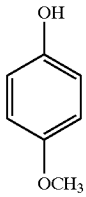
(II-49)
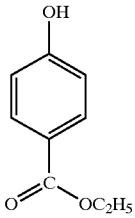
(II-50)
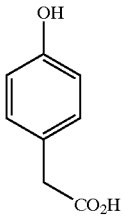
(II-51)
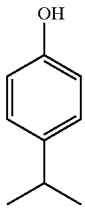

-continued
(II-53)
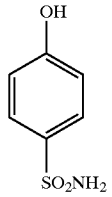
(II-55)
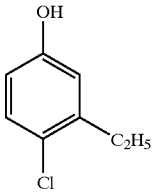
(II-56)
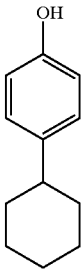
(II-57)
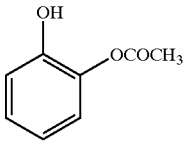
(II-58)
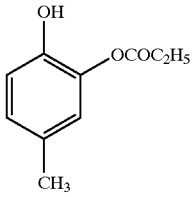
(II-60)
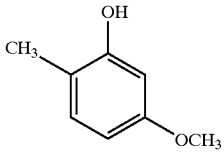
(II-61)
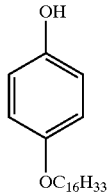
(II-62)
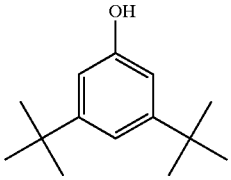
-continued
(II-63)
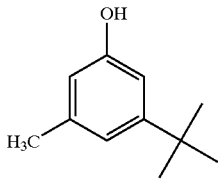
(I--64)
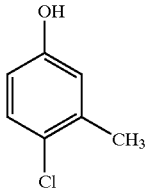
(II-65)
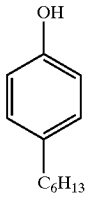
(II-67)
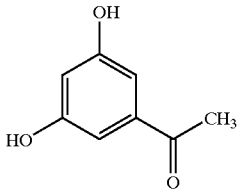
(II-69)
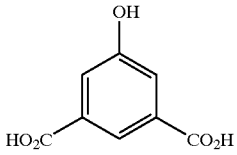
(II-70)
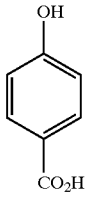
(II-71)
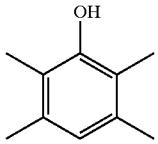
(II-72)
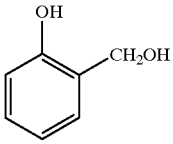

-continued
(II-73)
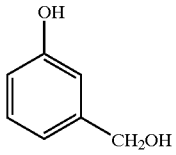
(II-74)
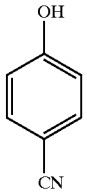
(II-75)
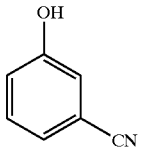
(II-76)
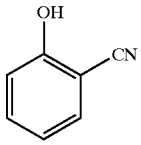
(II-77)
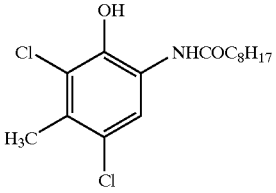
(II-78)
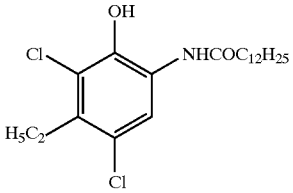
(II-79)
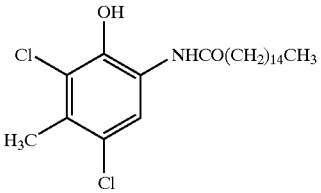
(II-80)
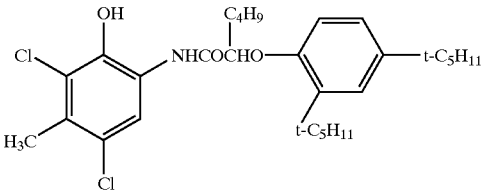
-continued
(II-81)
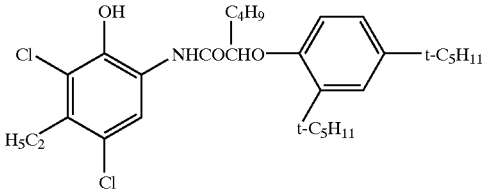
(II-82)
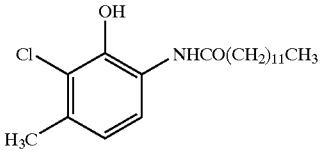
(II-85)
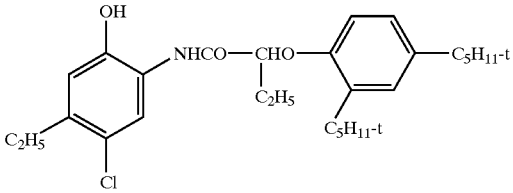
(II-87)
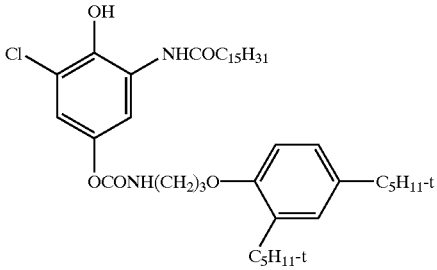
(II-88)
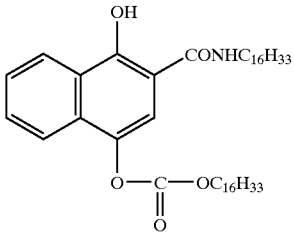
(II-89)
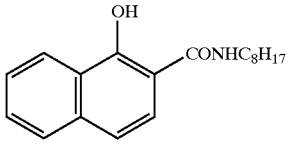
(II-90)
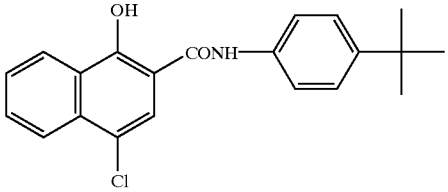
(II-91)
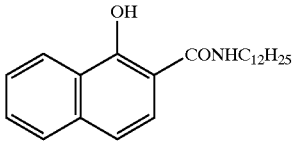

-continued
(II-92)
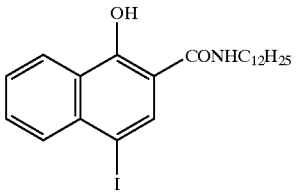
(II-93)
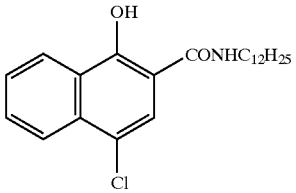
(II-94)
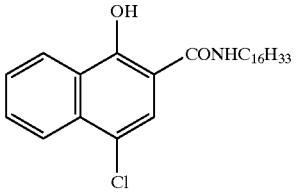
(II-95)
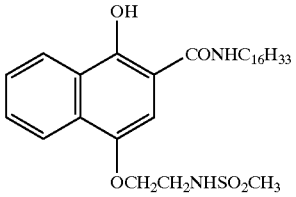
(II-96)
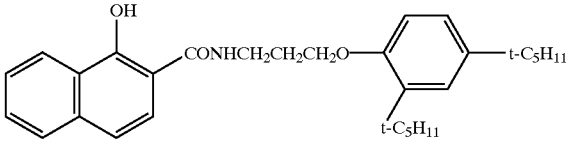
(II-97)
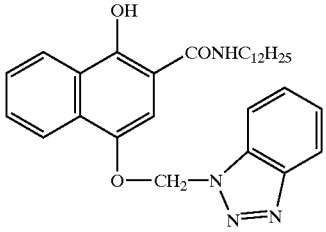
(II-98)
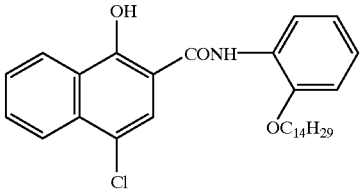
(II-99)
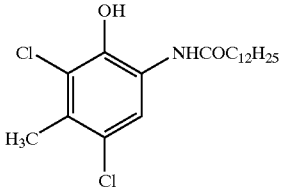
-continued
(II-100)
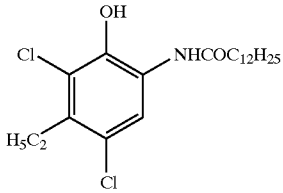
(II-101)
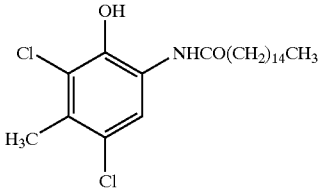
(II-102)
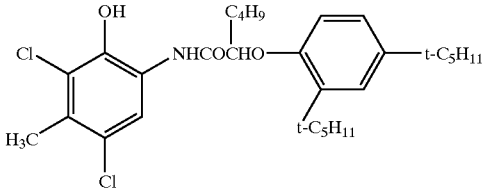
(II-103)
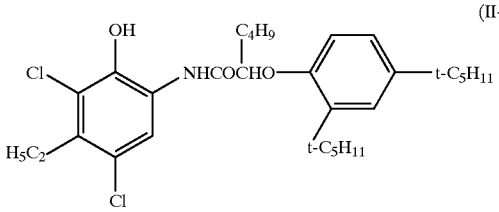
(II-104)
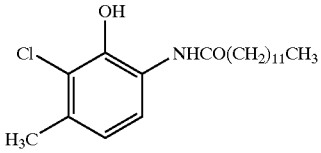
(II-105)
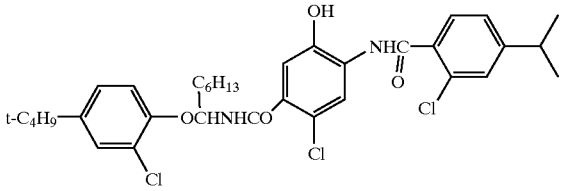
(II-106)
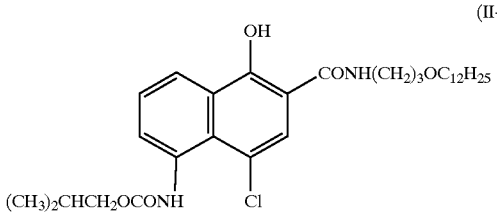
(II-107)
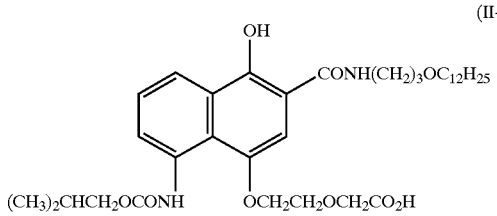

-continued
(II-108)
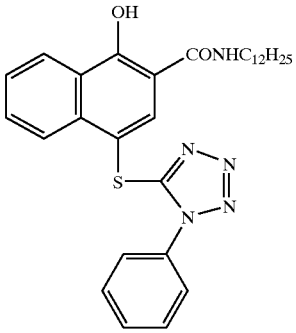
(II-109)
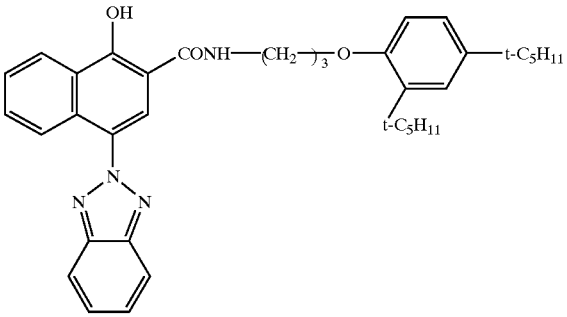
(II-110)
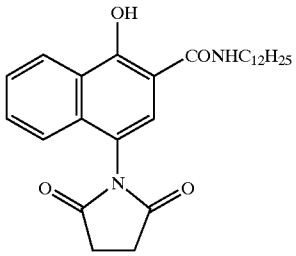
(II-111)
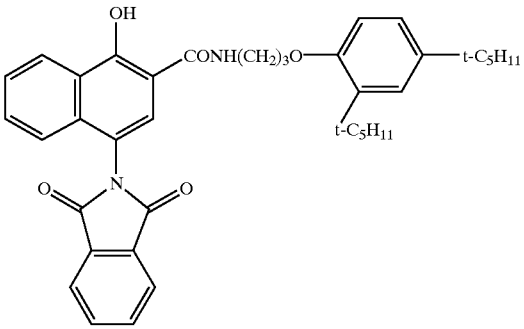
(II-112)
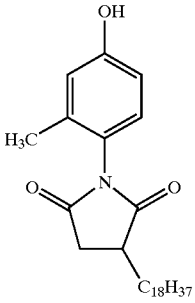
-continued
(II-113)
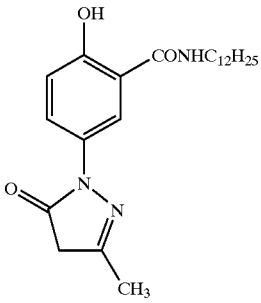
(II-114)
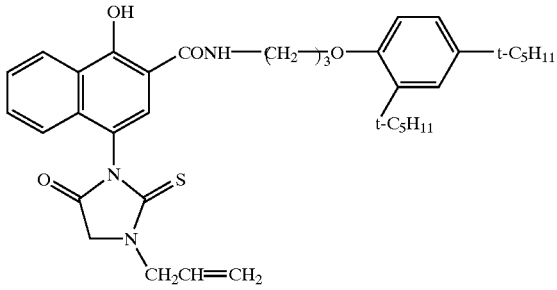
(II-115)
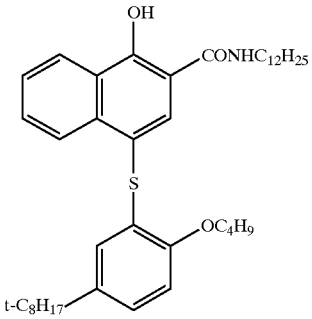
(II-116)
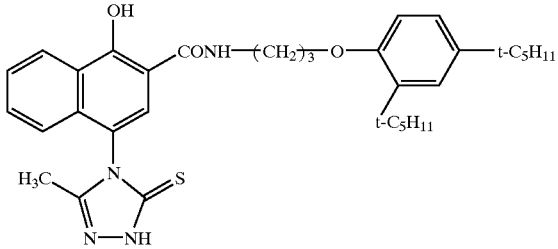
(II-117)
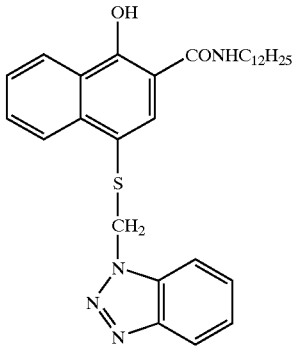

-continued (II-118)

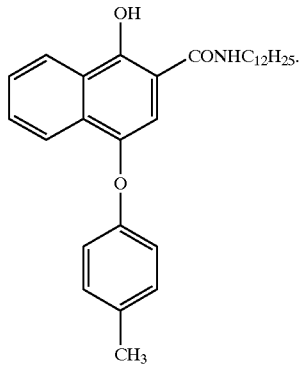

17. A photothermographic material comprising at least (a) a photosensitive silver halide, (b) a reducible silver salt, (c) a reducing agent represented by the following formula (1), (d) a binder, and (e) a phenol compound represented by the following formula (2) on the same side of the support:

(1)

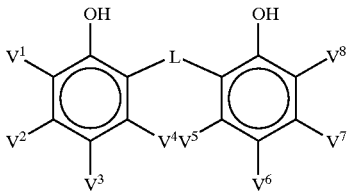

wherein, in the formula (1), $V^1$ to $V^8$ each independently represent hydrogen atom or a substituent, L represents a bridging group consisting of —CH($V^9$)- or —S—, and $V^9$ represents hydrogen atom or a substituent;

(2)

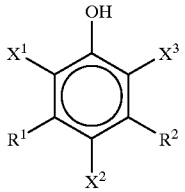

wherein $R^1$ and $R^2$ each independently represent hydrogen atom or a substituent, $X^1$ to $X^3$ each independently represent hydrogen atom or a substituent, provided that the substituents represented by $X^1$ to $X^3$ do not represent hydroxy group, and when the substituents represented by $X^1$ to $X^3$ are bonded to the phenol ring via nitrogen atoms, $X^1$ to $X^3$ represent a nitrogen-containing heterocyclic group or a group represented as —NH—C(=O)—$R^4$ where $R^4$ represents a substituent having 8–40 carbon atoms, or the substituents represented by $R^1$, $R^2$ and $X^1$ to $X^3$ may be bound to each other to form a ring with the proviso that the compound of formula (2) is not any of the following compounds, (II-4)

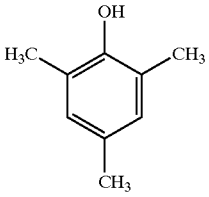

-continued (II-6)

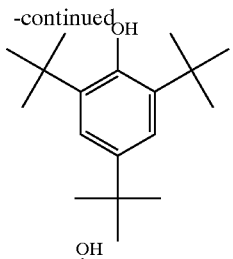

(II-13)

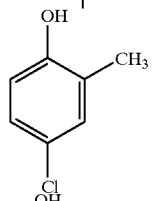

(II-52)

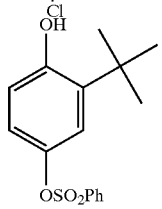

(II-54)

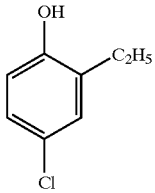

(II-59)

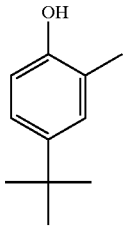

(II-66)

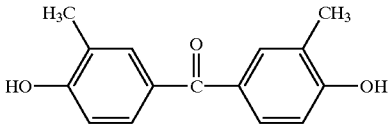

(II-68)

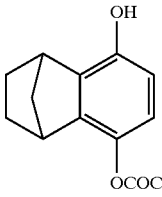

(II-84)

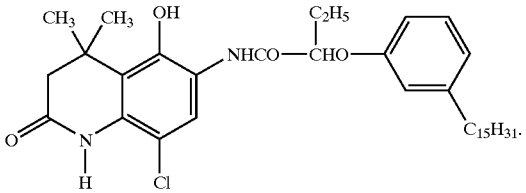

* * * * *